US011014371B2

(12) United States Patent
Horade

(10) Patent No.: US 11,014,371 B2
(45) Date of Patent: May 25, 2021

(54) IMAGE RECORDING APPARATUS

(71) Applicant: BROTHER KOGYO KABUSHIKI KAISHA, Nagoya (JP)

(72) Inventor: Kenta Horade, Toukai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/724,769

(22) Filed: Dec. 23, 2019

(65) Prior Publication Data

US 2020/0122475 A1 Apr. 23, 2020

Related U.S. Application Data

(63) Continuation of application No. 15/938,107, filed on Mar. 28, 2018, now Pat. No. 10,556,440.

(30) Foreign Application Priority Data

Mar. 31, 2017 (JP) ..... JP2017-072995

(51) Int. Cl.
*B41J 2/175* (2006.01)
*B41J 2/045* (2006.01)
(Continued)

(52) U.S. Cl.
CPC ..... *B41J 2/17566* (2013.01); *B41J 2/04535* (2013.01); *B41J 2/04581* (2013.01);
(Continued)

(58) Field of Classification Search
CPC ..... B41J 2/1751; B41J 2/17566; B41J 2002/17569; B41J 2002/17573; B41J 2002/17576; B41J 2002/17589
See application file for complete search history.

(56) References Cited

U.S. PATENT DOCUMENTS 8,596,735 B2 12/2013 Koganehira
2002/0085050 A1* 7/2002 Aruga ..... B41J 2/17509 347/7

(Continued)

FOREIGN PATENT DOCUMENTS

EP 2 990 208 A1 3/2016
JP 2008-213162 A 9/2008

(Continued)

OTHER PUBLICATIONS

Notice of Allowance dated Sep. 23, 2019 received in U.S. Appl. No. 15/938,107.

(Continued)

*Primary Examiner* — Matthew Luu
*Assistant Examiner* — Kendrick X Liu
(74) *Attorney, Agent, or Firm* — Scully Scott Murphy and Presser

(57) ABSTRACT

The image recording apparatus has a head, a tank, a case that receives a cartridge, and a controller. When the cartridge is installed in the case of the image recording apparatus, the liquid in the cartridge flows to the tank by a difference between a liquid level in the cartridge and a liquid level in the tank. The controller controls a display to display a first notification indicating an ink cartridge based on receiving a first signal output from a sensor when a liquid level in an ink chamber reached a specific position. The controller, after receiving the first signal from the sensor, counts a count value indicating an amount of discharged liquid from the head. Further, the controller, in response to the count value reaching a first threshold, controls the display to display a second notification.

14 Claims, 13 Drawing Sheets

(51) Int. Cl.

| | |
|---|---|
| ***B41J 29/46*** | (2006.01) |
| ***B41J 29/38*** | (2006.01) |
| ***B41J 29/13*** | (2006.01) |

(52) U.S. Cl.

CPC ..... *B41J 2/1752* (2013.01); *B41J 2/17509* (2013.01); *B41J 2/17513* (2013.01); *B41J 2/17523* (2013.01); *B41J 2/17553* (2013.01); *B41J 29/13* (2013.01); *B41J 29/38* (2013.01); *B41J 29/46* (2013.01); *B41J 2002/17569* (2013.01); *B41J 2002/17573* (2013.01); *B41J 2002/17576* (2013.01); *B41J 2002/17589* (2013.01)

(56) References Cited

U.S. PATENT DOCUMENTS

| | | | |
|---|---|---|---|
| 2007/0008351 | A1 | 1/2007 | Teshigawara et al. |
| 2008/0204488 | A1 | 8/2008 | Usui |
| 2011/0012953 | A1 | 1/2011 | Nakamura |
| 2011/0050766 | A1 | 3/2011 | Matsumoto et al. |
| 2016/0052290 | A1 | 2/2016 | Takahashi et al. |
| 2016/0059571 | A1* | 3/2016 | Kobayashi ..... B41J 2/17513 347/7 |
| 2016/0279962 | A1 | 9/2016 | Ishida et al. |

FOREIGN PATENT DOCUMENTS

| | | | |
|---|---|---|---|
| JP | 5164570 | B2 | 3/2013 |
| JP | 2016-043604 | A | 4/2016 |
| WO | 2017130238 | A1 | 8/2017 |

OTHER PUBLICATIONS

Office Action dated Jun. 14, 2019 received in U.S. Appl. No. 15/938,107.

International Search Report and Written Opinion dated Nov. 23, 2018 from related PCT/JP2018/013186.

Office Action dated Dec. 26, 2018 received in U.S. Appl. No. 15/938,107.

Official Action dated Mar. 2, 2021 received in Japanese Patent Application No. JP 2017-072995 together with an English language translation.

* cited by examiner

IMAGE RECORDING APPARATUS

CROSS-REFERENCE TO RELATED APPLICATION

This application is a continuation application of U.S. application Ser. No. 15/938,107 filed on Mar. 28, 2018, which claims priority from Japanese Patent Application No. 2017-072995 filed on Mar. 31, 2017, the entire subject matters of which is incorporated herein by reference.

TECHNICAL FIELD

The present disclosure relates to an image recording apparatus includes a cartridge with a first liquid chamber and a tank with a second liquid chamber.

BACKGROUND

In the related art, there is known a liquid droplet ejecting apparatus including an apparatus body that includes a liquid ejecting head and a sub-tank and a cartridge that includes a liquid chamber and is detachably installed on the apparatus body (for example, see JP-A-2008-213162).

When ink flows from the sub-tank to the liquid ejecting head, the ink flows from the liquid chamber of the cartridge to the sub-tank. The sub-tank and the liquid chamber are both opened to the atmosphere. Thus, a liquid level of the ink in the sub-tank and a liquid level of the ink in the liquid chamber of the cartridge are at the same height in the end.

In the liquid droplet ejecting apparatus, a detection object for detecting a remaining amount of liquid in the liquid chamber is inside the liquid chamber of the cartridge.

In the liquid droplet ejecting apparatus disclosed in JP-A-2008-213162, a remaining amount of ink of the cartridge is detected, but a remaining amount of ink in the sub-tank is not determined. Accordingly, when a user is informed that the remaining amount of ink in the cartridge is zero or equal to or less than a predetermined amount, it is necessary to immediately exchange the cartridge. However, even after the ink stored in the cartridge is used up, the ink is stored in the sub-tank. Therefore, there is ink to be consumed for image recording or the like. When a user is informed that the sub-tank is empty on the assumption that the ink stored in the sub-tank can be used, the remaining amount of ink in the cartridge is zero or equal to or less than a predetermined amount. Image recording or the like can be performed even later. As a result, the user has an enough time available to exchange the cartridge. On the other hand, when the ink stored in the sub-tank is completely consumed, air flows from the sub-tank to a recording head. Thus, an ejection failure occurs in the recording head or a large amount of ink is assumed for maintenance to recover the ejection failure in some cases. Accordingly, it is necessary to determine the remaining amount of ink in the sub-tank with high precision so that air does not flow in the recording head.

SUMMARY

The present disclosure has been made in view of the above circumstances, and one of objects of the present disclosure is to provide an image recording apparatus including a cartridge with a first liquid chamber and a tank with a second liquid chamber in which a cartridge can be used until a remaining amount of liquid stored in the first liquid chamber is small and a mechanism capable of determining a remaining amount of liquid stored in the second liquid at low cost with high precision is provided.

According to an aspect of the present disclosure, there is provided an image recording apparatus has a head, a tank, a case that receives a cartridge, and a controller. When the cartridge is installed in the case of the image recording apparatus, the liquid in the cartridge flows to the tank by a difference between a liquid level in the cartridge and a liquid level in the tank. The controller controls a display to display a first notification indicating an ink cartridge based on receiving a first signal output from a sensor when a liquid level in an ink chamber reached a specific position. The controller, after receiving the first signal from the sensor, counts a count value indicating an amount of discharged liquid from the head. Further, the controller, in response to the count value reaching a first threshold, controls the display to display a second notification.

DETAILED DESCRIPTION

Figure 1A:
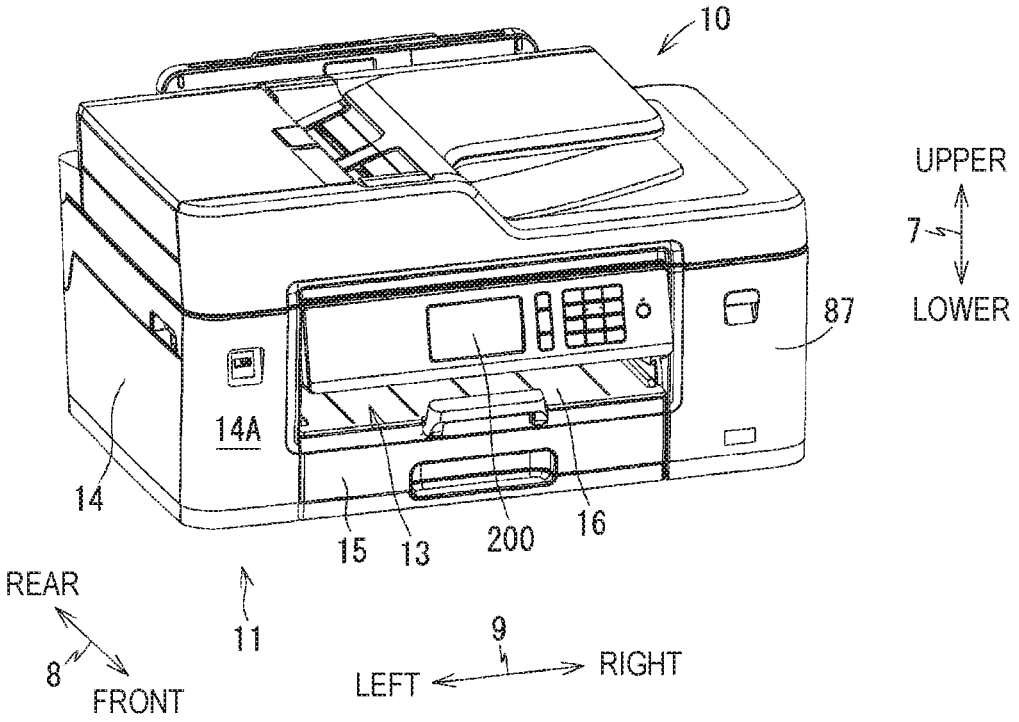
FIG. 1A is an external perspective view illustrating a multi function device 10 in which a cover 87 is at a blocking position.

Hereinafter, an embodiment of the present disclosure will be described. The embodiment to be described below is merely an example of the present disclosure and it is needless to say that the embodiment of the present disclosure can be appropriately modified within the scope of the present disclosure departing from the gist of the present disclosure. Upper and lower directions 7 are defined with reference to an orientation at which a multi function device 10 is installed to be usable on a horizontal surface (which is an orientation of FIG. 1 and is sometimes referred to as a "usage orientation"). Front and rear directions 8 are defined setting a surface on which an opening 13 of the multi function device 10 is installed as a front surface 14A. Right and left directions 9 are defined when the multi function device 10 is viewed from the front surface. In the embodiment, at the usage orientation, the upper and lower directions 7 are equivalent to the vertical direction, and the front and rear directions 8 and the right and left directions 9 are equivalent to the horizontal direction. The front and rear directions 8 and the right and left directions 9 are orthogonal to each other.

[Overall Configuration of Multi Function Device 10]

Figure 1B:
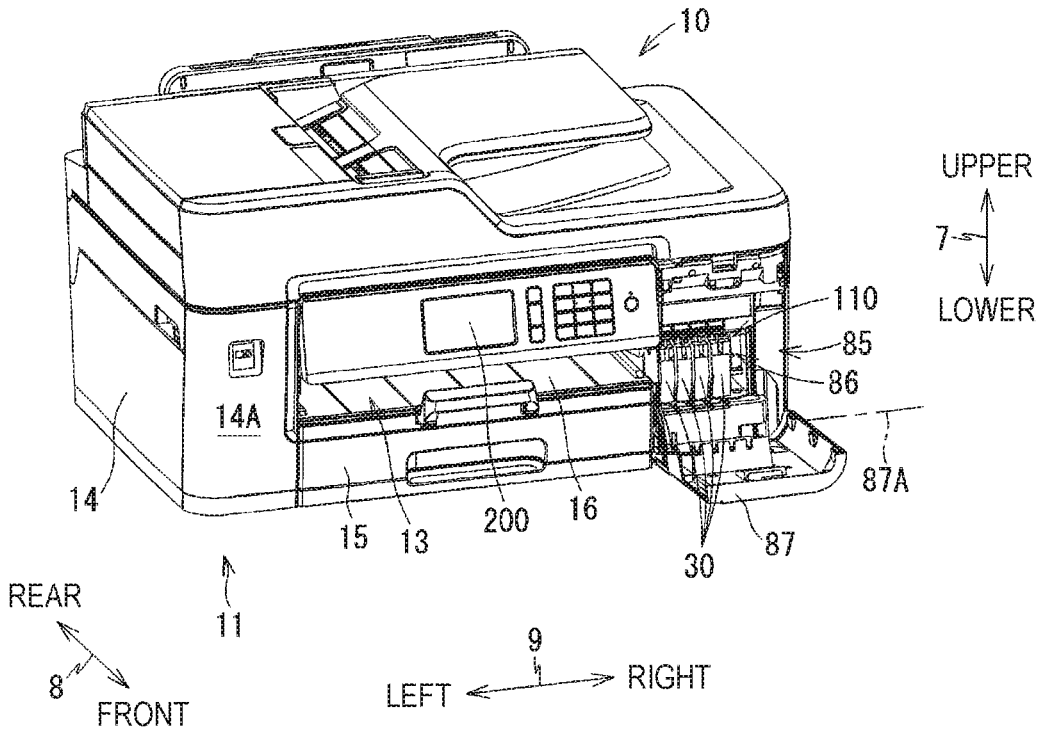
FIG. 1B is an external perspective view illustrating the multi function device 10 in which the cover 87 is at an opening position.

As illustrated in FIGS. 1A and 1B, the multi function device 10 (which is an example of an image recording apparatus) has a substantially rectangular boxed shape. The multi function device 10 includes a printer 11 that records an image on a sheet 12 (see FIG. 2) in a lower portion in conformity to an ink jet recording scheme. The printer 11 includes a casing 14 in which an opening 13 is formed in the front surface 14A. A display 200 (which is an example of a notification device) that displays various kinds of information is installed on the front surface 14A of the casing 14.

Figure 2:
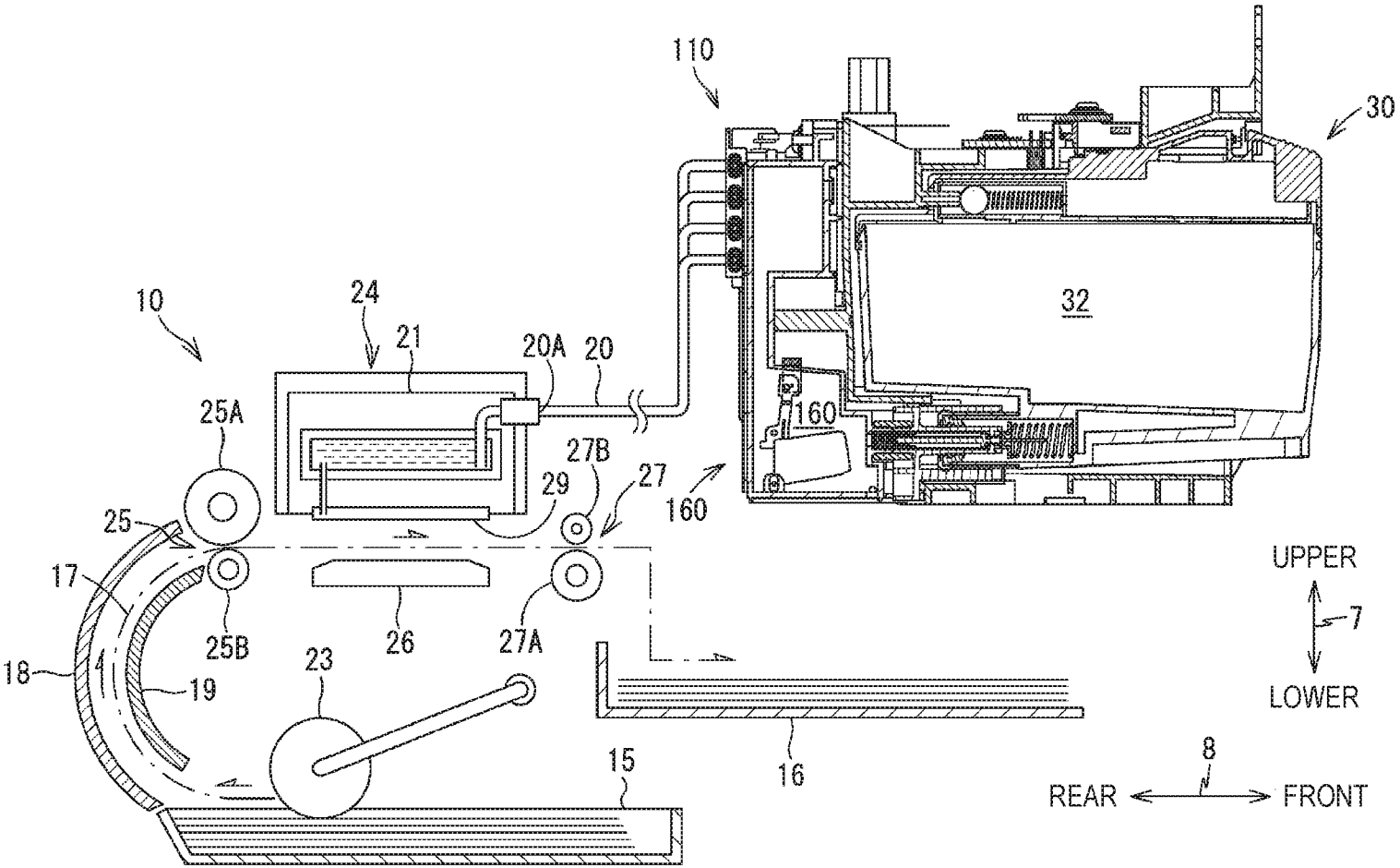
FIG. 2 is a longitudinal sectional view schematically illustrating an inner structure of a printer 11.

As illustrated in FIG. 2, a feeding roller 23, a feeding tray 15, a discharge tray 16, a pair of transport rollers 25, a recording unit 24, a pair of discharging rollers 27, a platen 26, and a installation case 110 (see FIG. 1B) are located inside the casing 14. The multi function device 10 has various functions such as a facsimile function and a printing function.

[Feeding Tray 15, Discharge Tray 16, Feeding Roller 23]

As illustrated in FIG. 1, the feeding tray 15 is inserted into and extracted from the multi function device 10 through the opening 13 in the front and rear directions 8 by a user. The opening 13 is located in the middle of the front surface 14A of the casing 14 in the right and left directions 9. As illustrated in FIG. 2, the feeding tray 15 can support the plurality of stacked sheets 12.

The discharge tray 16 is located above the feeding tray 15. The discharge tray 16 supports the sheet 12 discharged by the pair of discharging rollers 27.

The feeding roller 23 feeds the sheet 12 supported by the feeding tray 15 to a conveyance path 17. The feeding roller 23 is driven by a feeding motor 172 (see FIG. 9).

[Conveyance Path 17]

As illustrated in FIG. 2, the conveyance path 17 is a space formed by an outer guide member 18 and an inner guide number 19 facing each other at a predetermined interval, with a part of the conveyance path 17 being inside the printer 11. The conveyance path 17 is a path extending backwards at the rear end of the feeding tray 15. The conveyance path 17 is a path that is turned forwards in a U shape extending upwards in the rear portion of the printer 11 and reaches the discharge tray 16 via a space between the recording unit 24 and the platen 26. The conveyance path 17 between the pair of transport rollers 25 and the pair of discharging rollers 27 is installed in a substantial middle of the multi function device 10 in the right and left directions 9 and extends in the front and rear directions 8. A transport direction of the sheet 12 inside the conveyance path 17 is indicated by an arrow of a dot and dash line in FIG. 2.

[Pair of Transport Rollers 25]

As illustrated in FIG. 2, the pair of transport rollers 25 is located in the conveyance path 17. The pair of transport rollers 25 includes a transport roller 25A and a pinch roller 25B facing each other. The transport roller 25A is driven by a transport motor 171 (see FIG. 9). The pinch roller 25B is rotated with rotation of the transport roller 25A. The sheet 12 is transported in the transport direction (forwards) with being pinched by the transport roller 25A and the pinch roller 25B positively rotated by positive rotation of the transport motor 171.

[Pair of Discharging Rollers 27]

As illustrated in FIG. 2, the pair of discharging rollers 27 is located downstream in the transport direction from the pair of transport rollers 25 in the conveyance path 17. The pair of discharging rollers 27 includes a discharging roller 27A and a spur 27B facing each other. The discharging roller 27A is driven by the transport motor 171 (see FIG. 9). The spur 27B is rotated with rotation of the discharging roller 27A. The sheet 12 is transported in the transport direction (forwards) with being pinched by the discharging roller 27A and the spur 27B positively rotated by positive rotation of the transport motor 171.

[Recording Unit 24]

As illustrated in FIG. 2, the recording unit 24 is located between the pair of transport rollers 25 and the pair of discharging rollers 27 in the conveyance path 17. The recording unit 24 faces the platen 26 with the conveyance path 17 interposed therebetween in the upper and lower directions 7. The recording unit 24 is located above the conveyance path 17 and the platen 26 is located below the transport roller 17. The recording unit 24 includes a carriage 22 and a recording head 21.

Figure 3:
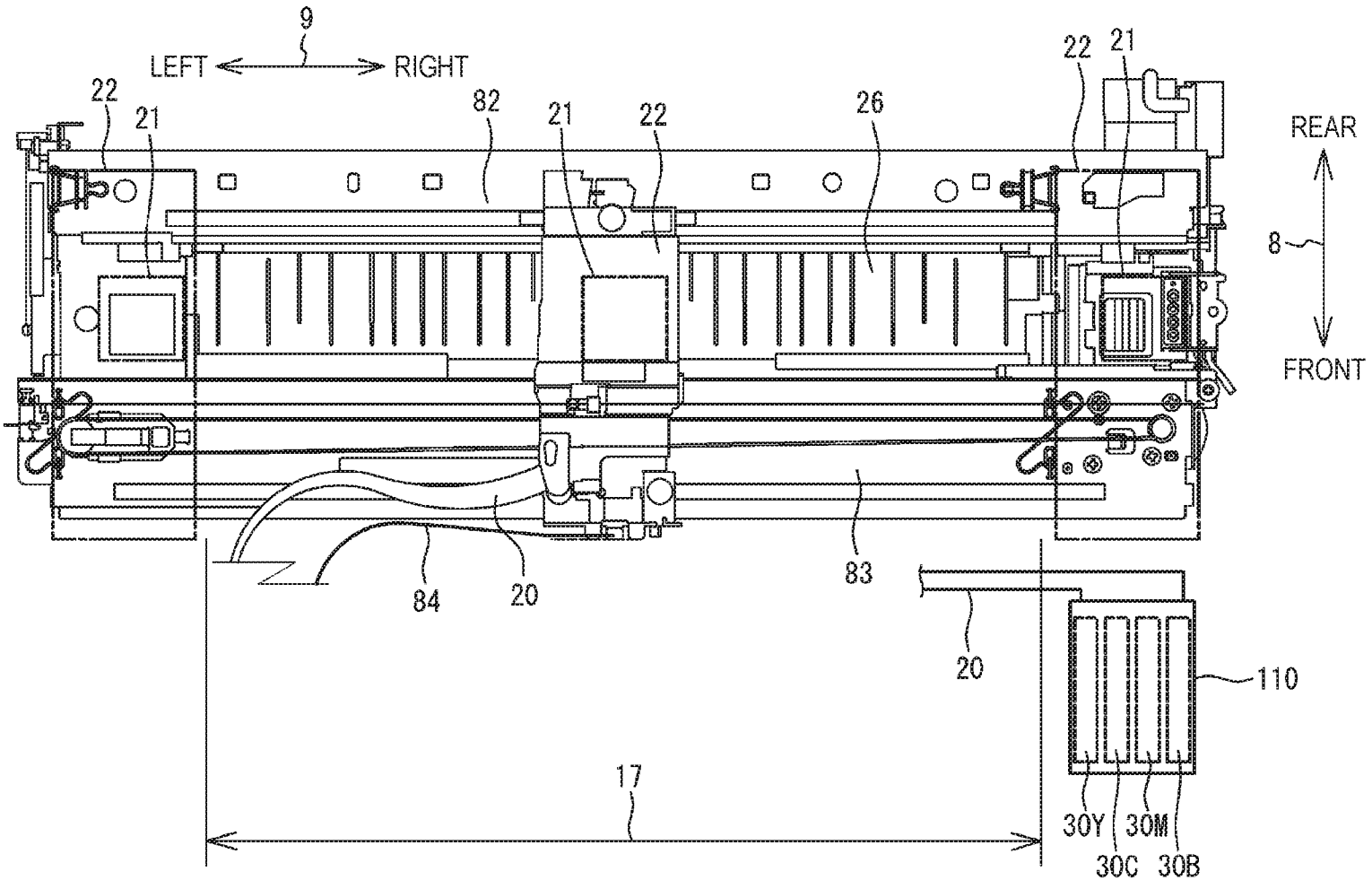
FIG. 3 is a plan view illustrating disposition of a carriage 22, a platen 26, and a installation case 110.

As illustrated in FIG. 3, the carriage 22 is supported by guide rails 82 and 83 installed to extending in the right and left directions 9 at positions separated in the front and rear directions 8. The guide rails 82 and 83 are supported by a frame (not illustrated) of the printer 11. The carriage 22 is connected to a known belt mechanism installed in the guide rail 83. The belt mechanism is driven by a carriage driving motor 173 (see FIG. 9). The carriage 22 connected to the belt mechanism reciprocates in the right and left directions 9 by driving of the carriage driving motor 173. A movement region of the carriage 22 reaches the right and left sides of the conveyance path 17, as indicated by dot and dash lines of FIG. 3.

Ink tubes 20 and a flexible flat cable 84 extend from the carriage 22.

The ink tubes 20 connect the installation case 110 to the recording head 21. The ink tube 20 supplies ink (which is an example of a liquid) stored in each ink cartridge 30 (which is an example of a cartridge) installed in the installation case 110 to the recording head 21 (which is an example of a head). An ink cartridge 30B that stores black ink, an ink cartridge 30M that stores magenta ink, an ink cartridge 30C that stores cyan ink, and an ink cartridge 30Y that stores yellow ink are installed in the installation case 110. The four ink cartridges are collectively referred to as the ink cartridges 30. The ink circulates an inner space of the ink tube 20. Four ink tubes 20 in which ink of each color (black, magenta, cyan, and yellow) circulates are installed to correspond to the ink cartridges 30B, 30M, 30C, and 30Y and the bundled ink tubes are connected to the recording head 21 mounted on the carriage 22. The inner space of the ink tubes 20 is an example of a fourth passage. The end of the ink tubes 20 connected to the recording head 21 is an example of the other end of the fourth passage.

The flexible flat cable 84 electrically connects a controller 130 (see FIG. 9) to the recording head 21. The flexible flat cable 84 delivers a control signal output from the controller 130 to the recording head 21.

As illustrated in FIG. 2, the recording head 21 is mounted on the carriage 22. The recording heads 21 includes a plurality of nozzles 29 formed on a lower surface and piezoelectric elements 56 (see FIG. 9) that discharge ink droplets from the nozzles 29 by deforming parts of ink passages formed inside the recording head 21. As will be described below, the piezoelectric elements 56 operates when the controller 130 supplies electricity.

The recording unit 24 is controlled by the controller 130. When the carriage 22 is moved in the right and left directions 9, the recording head 21 discharges the ink droplets from the nozzles 29 to the conveyance path 17. Thus, an image is recorded on the sheet 12 supported by the platen 26. Thus, the ink stored in each ink cartridge 30 is consumed.

[Platen 26]

As illustrated in FIG. 2, the platen 26 is located between the pair of transport rollers 25 and the pair of discharging rollers 27 in the conveyance path 17. The platen 26 faces the recording unit 24 with the conveyance path 17 interposed therebetween in the upper and lower directions 7. The platen 26 supports the sheet 12 transported by the pair of transport rollers 25 from the lower side.

[Cover 87]

As illustrated in FIG. 1B, an opening 85 is formed to the right of the front surface 14A of the casing 14. An accommodation space 86 that can accommodate the installation case 110 is formed on the rear side of the opening 85. The cover 87 is fitted in the casing 14 to block the opening 85. The cover 87 is rotatable about a rotation axis line 87A (a rotation center) extending in the right and left directions 9 between a blocking position (a position illustrated in FIG. 1A) at which the opening 85 is blocked and an opening position (a position illustrated in FIG. 1B) at which the opening 85 is opened.

[Installation Case 110]

As illustrated in FIG. 1B, the installation case 110 is located in a front right portion of the casing 14. As illustrated in FIG. 3, the installation case 110 is located on the front side of the recording head 21. The installation case 110 is located on the right side of the conveyance path 17.

As illustrated in FIGS. 4A to 6, the installation case 110 includes a contact 106, a rod 125, an installation sensor 113, a lock shaft 145, a rank 103, and a liquid level sensor 55 (which is an example of a sensor).

The installation case 101 can accommodate four ink cartridges 30 that store cyan, magenta, yellow, and black, respectively. The ink cartridge 30 is installed in the installation case 101 by moving the ink cartridge 30 to the rear side and is detached from the installation case 101 by moving the ink cartridge 30 to the front side. Four contacts 106, four rods 125, four installation sensors 113, four lock shafts 145, four tanks 103, and four liquid level sensors 55 are installed to correspond to four ink cartridges 30. The number of ink cartridges 30 that can be accommodated in the installation case 110 is not limited to 4.

Each contact 106 has the same configuration, each rod 125 has the same configuration, each installation sensor 113 has the same configuration, each lock shaft 145 has the same configuration, and each liquid level sensor 55 has the same configuration. Therefore, in the description of each unit to be described below, only the configurations of one contact 106, one rod 125, one installation sensor 113, one lock shaft 145, and one liquid level sensor 55 will be described and the description of the respective three remaining units will be omitted.

The four tanks 103 store one-color ink of black, magenta, cyan, and yellow, respectively. In the following description, the four tanks are collected referred to as the tanks 103, the tank storing the black ink is referred to as a tank 103B, the tank storing the magenta ink is referred to as a tank 103M, the tank storing the cyan ink is referred to as a tank 103C, and the tank storing the yellow ink is referred to as a tank 103Y.

Figure 4A:
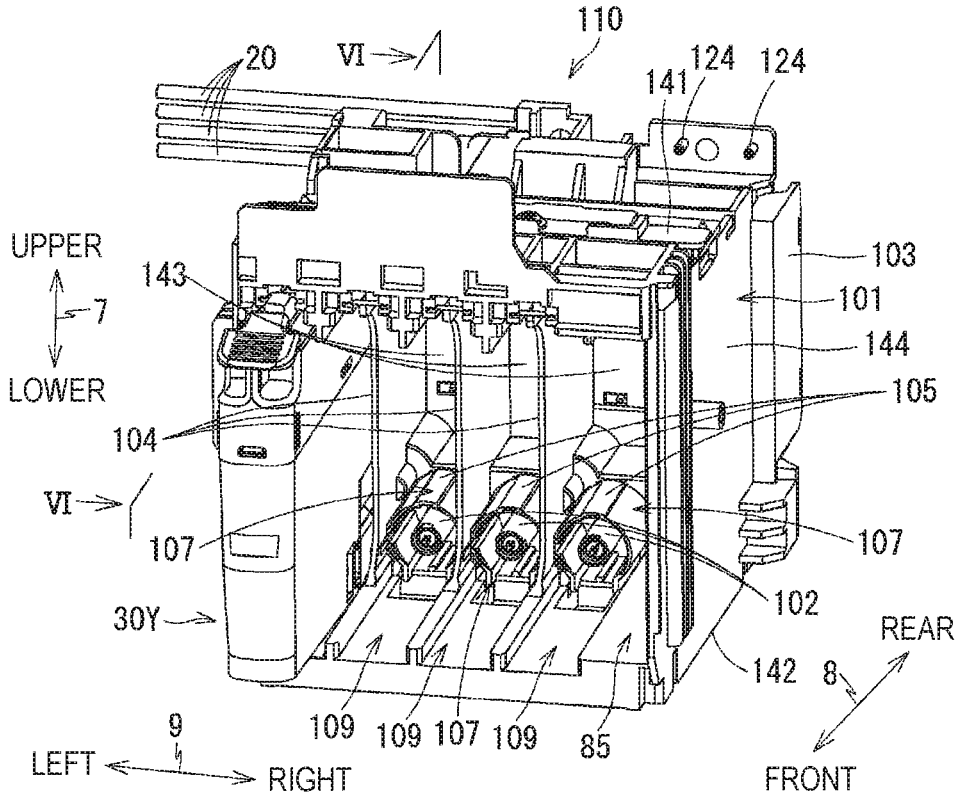
FIG. 4A is an external perspective view illustrating a side of openings 112 of the installation case 110 when an ink cartridge 30Y is installed.
Figure 4B:
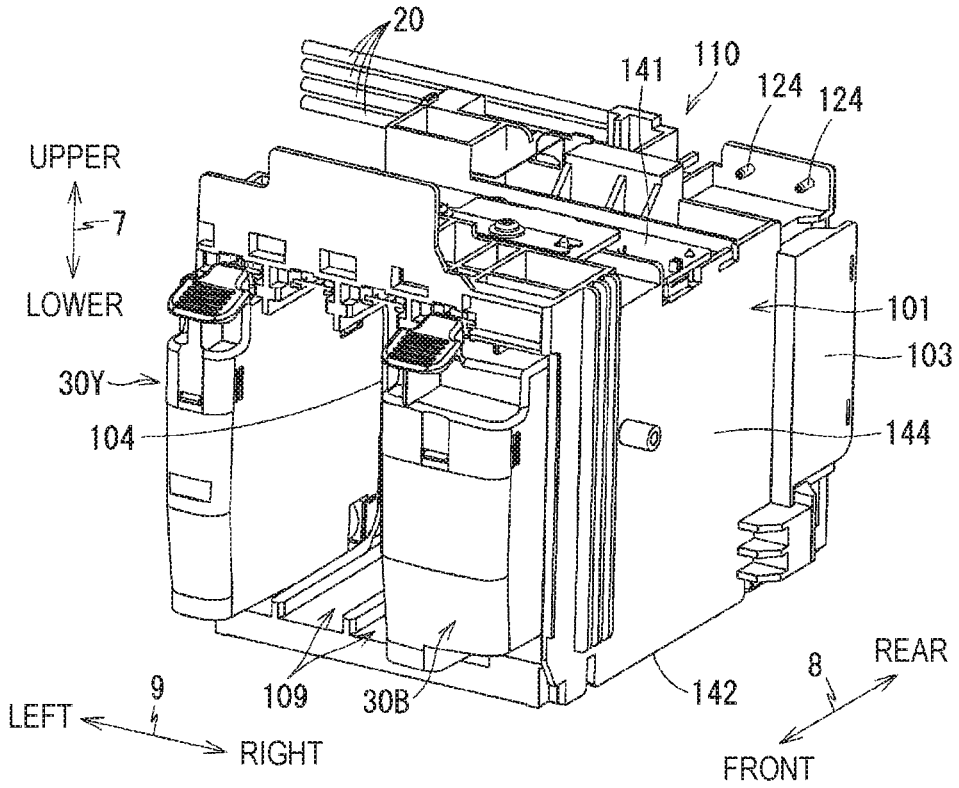
FIG. 4B is a an external perspective view illustrating the side of the opening 112 when ink cartridges 30Y and 30B are installed.
Figure 5:
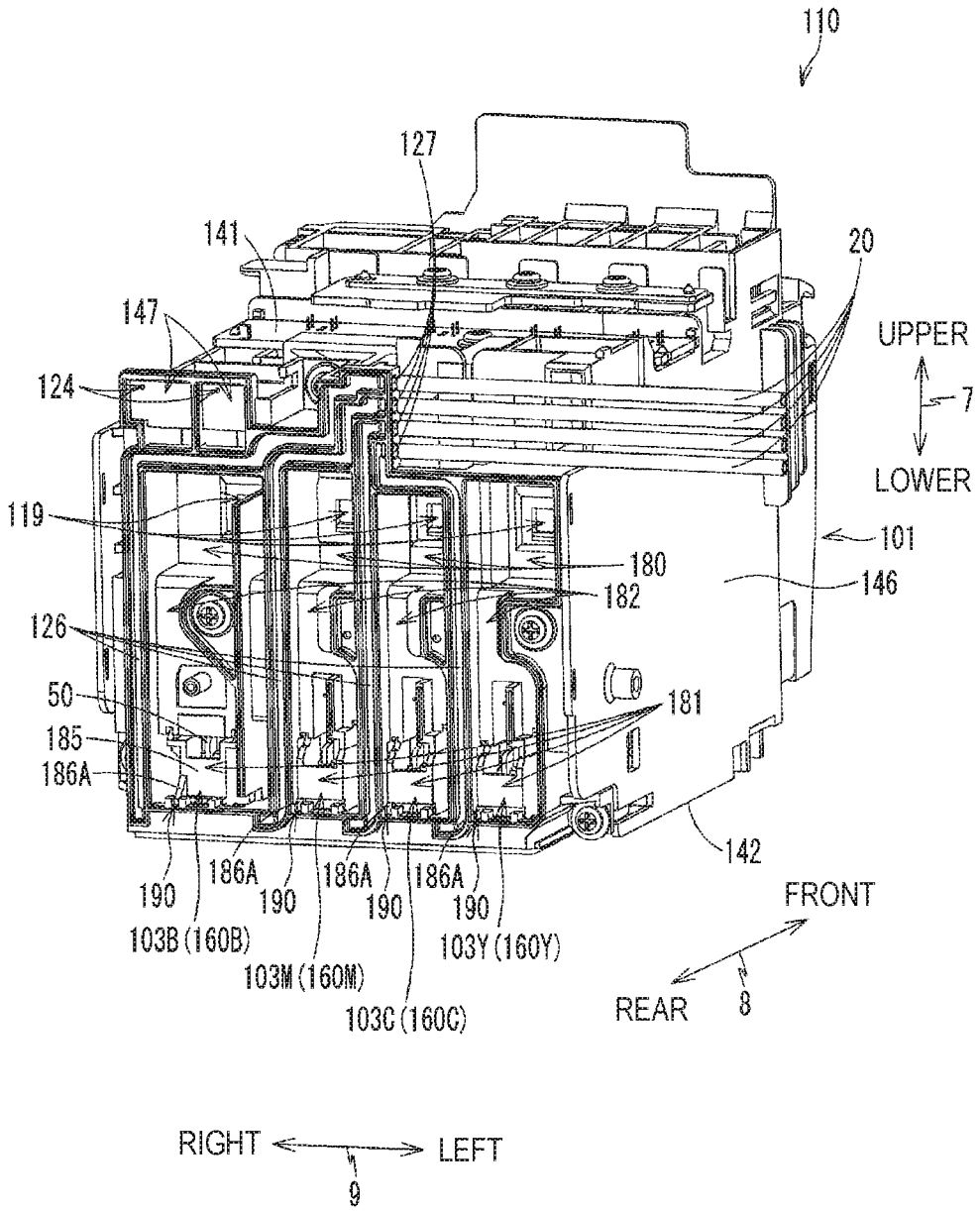
FIG. 5 is an external perspective view illustrating a side of a tank 103 of the installation case 110.
Figure 6:
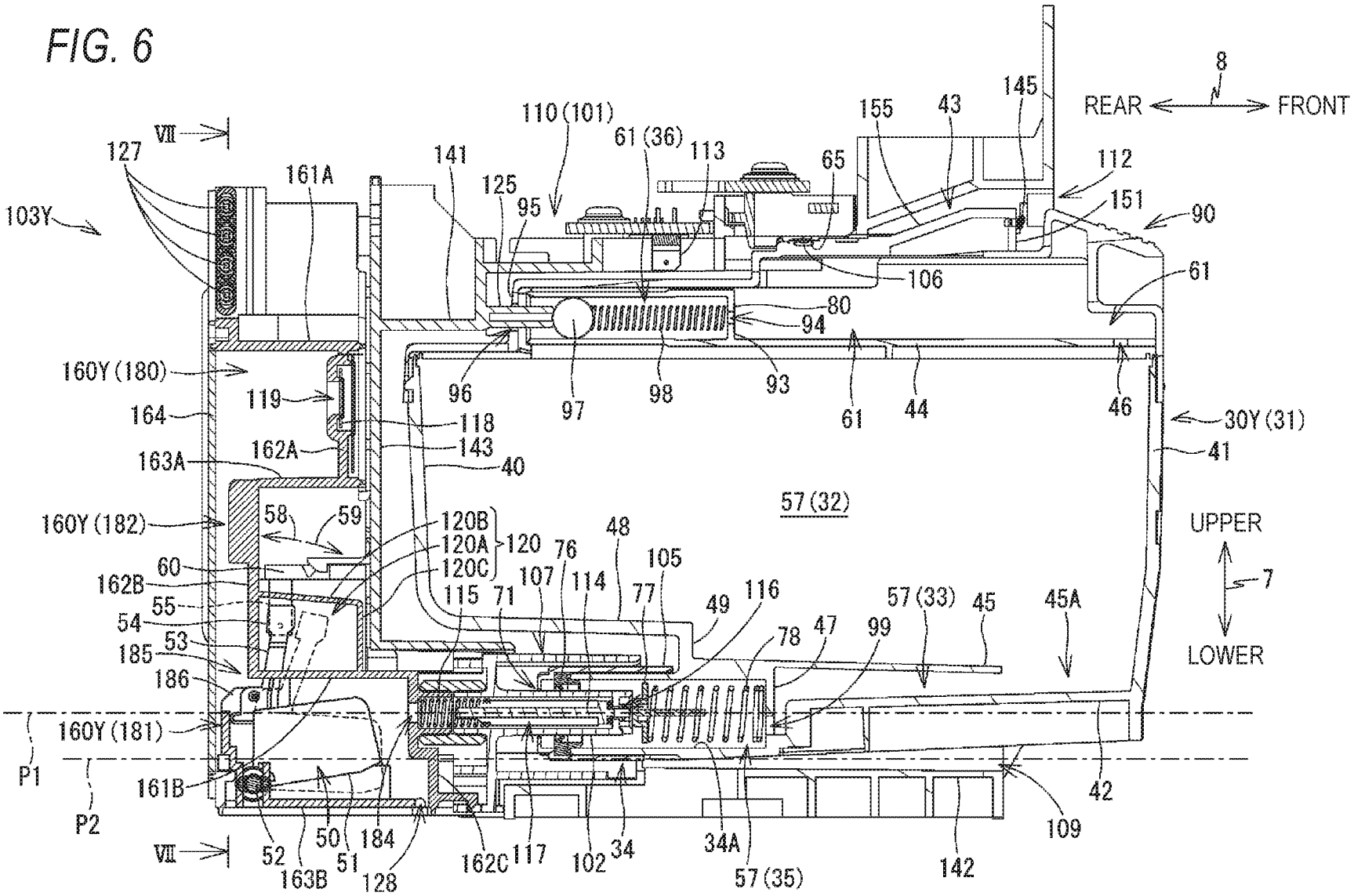
FIG. 6 is a sectional view taken along the line VI-VI of FIG. 4A.

As illustrated in FIGS. 4 to 6, the installation case 101 has a box-like shape that an inner space. The inner space of the installation case 101 is demarcated by a top wall 141 demarcating the upper end, a bottom wall 142 demarcating the lower end, a back wall 143 demarcating the rear end in the front and rear directions 8, and a pair of side walls 144 and 146 demarcating both ends in the right and left directions 9. On the other hand, the front end of the installation case 101 facing the back wall 143 in the front and rear directions 8 is opened to expose the inner space of the installation case 101. When the opening 85 of the installation case 101 is located at the position at which the cover 87 (see FIG. 1) is exposed, the opening 85 is exposed to the outside of the multi function device 10.

The ink cartridge 30 is inserted into and extracted from the installation case 101 through the opening 85 of the installation case 110. The ink cartridge 30 is guided in the front and rear directions 8 when the lower end of the ink cartridge 30 is inserted into a guide groove 109 formed on the bottom surface of the installation case 101. As illustrated in FIG. 4A, three plates 104 dividing the inner space into four spaces long in the upper and lower directions 7 are installed in the installation case 101. The installation case 101 accommodates the four ink cartridges 30 in the spaces divided by the plates 104 in the right and left directions 9.

FIG. 4A illustrates a state in which only the ink cartridge 30Y is installed in the installation case 110 among the four ink cartridges 30. FIG. 4B illustrates a state in which only the ink cartridges 30Y and 30B are installed in the installation case 110 among the four ink cartridges 30.

[Contact 106]

As illustrated in FIG. 6, the contact 106 is located on the lower surface of the top wall 141 of the installation case 101. The contact 106 protrudes from the lower surface of the top wall 141 downwards toward the inner space of the installation case 101. Although not illustrated in detail in each drawing, the contact 106 includes four pieces formed to be separated in the right and left directions 9. The four contacts 106 including the four pieces are formed to correspond to the four ink cartridges 30 that can be accommodated in the installation case 101. The disposition of the four contacts 106 corresponds to disposition of four electrodes 65 of the ink cartridges 30 to be described below. The contacts 106 have conductivity, and thus can be deformed elastically upwards. Any number of contacts 106 and any number of electrodes 65 can be used.

Figure 9:
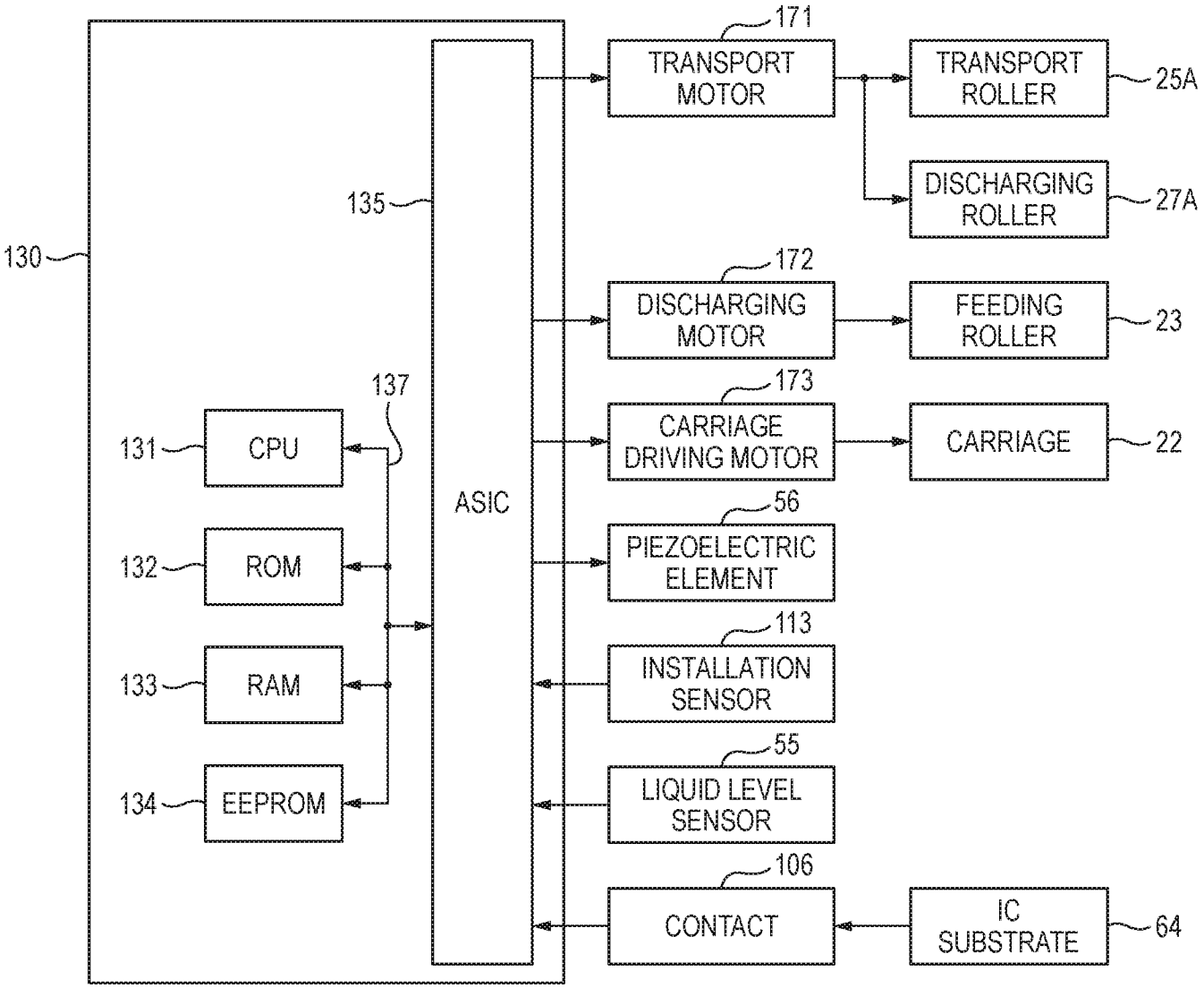
FIG. 9 is a block diagram illustrating a configuration of a controller 130.

The contact 106 is electrically connected to the controller 130 (see FIG. 9). The contact 106 engages with the corresponding electrode 65 to be electrically conducted, and thus a voltage is applied to the electrode 65, the electrode 65 is earthed, or power is supplied to the electrode 65. The contact 106 and the corresponding electrode 65 can be electrically conducted to access data stored in a memory of an IC of the ink cartridge 30. An output from the contact 106 is input to the controller 130.

[Rod 125]

As illustrated in FIG. 6, the rod 125 is formed above an ink needle 102 on the back wall 143 of the installation case 101. The rod 125 protrudes frontwards from the back wall 143 of the installation case 101. The rod 125 has a cylindrical shape. The rod 125 enters an atmospheric communication port 96 to be described below in a state in which the ink cartridge 30 is installed in the installation case 110, that is, the ink cartridge 30 is located at an installation position.

[Installation Sensor 113]

As illustrated in FIG. 6, the installation sensor 113 is located on the lower surface of the top wall 141 of the installation case 101. The installation sensor 113 detects whether the ink cartridge 30 is installed in the installation case 110. The installation sensor 113 is located on the front side of the rod 125 and the rear side of the contact 106. The installation sensor 113 includes a light-emitting unit and a light-receiving unit. The light-emitting unit is installed at to the right or left side of the light-receiving unit at an interval from the light-receiving unit. A light-shielding plate 67 to be described below in the ink cartridge 30 installed in the installation case 110 is located between the light-emitting unit and the light-receiving unit. In other words, the light-emitting unit and the light-receiving unit are located to face each other with the light-shielding plate 67 of the ink cartridge 30 installed in the installation case 110 interposed therebetween.

The installation sensor 113 outputs different detection signals in accordance with whether light radiated from the light-emitting unit in the right and left directions 9 is received by the light-receiving unit. For example, the installation sensor 113 outputs a low-level signal to the controller 130 (see FIG. 9) under the condition that the light output from the light-emitting unit may not be received by the light-receiving unit (that is, a light reception intensity is less than a predetermined intensity). Conversely, the installation sensor 113 outputs a high-level signal to the controller 130 (see FIG. 9) under the condition that the light output from the light-emitting unit can be received by the light-receiving unit (that is, a light reception intensity is equal to or greater than a predetermined intensity).

[Lock Shaft 145]

As illustrated in FIG. 6, the lock shaft 145 extends in the right and left directions 9 of the installation case 101 near the top wall 141 of the installation case 101 and near the opening 112. The lock shaft 145 is a member that has a rod-like shape extending in the right and left directions 9. The lock shaft 145 is, for example, a metal column. Both ends of the lock shaft 145 in the right and left directions 9 are fixed to the wall demarcating both ends of the installation case 101 in the right and left directions 9. The lock shaft 145 extends in the right and left directions 9 across the four spaces in which the four ink cartridges 30 can be accommodated.

The lock shaft 145 holds the ink cartridge 30 installed in the installation case 110 at the installation position. The ink cartridge 30 is installed in the installation case 110 to engage with the lock shaft 145. Thus, for the lock shaft 145, coil springs 78 and 98 of the ink cartridge 30 hold the ink cartridge 30 inside the installation case 110 against a force pressing the ink cartridge 30 forwards.

[Tank 103]

Figure 7:
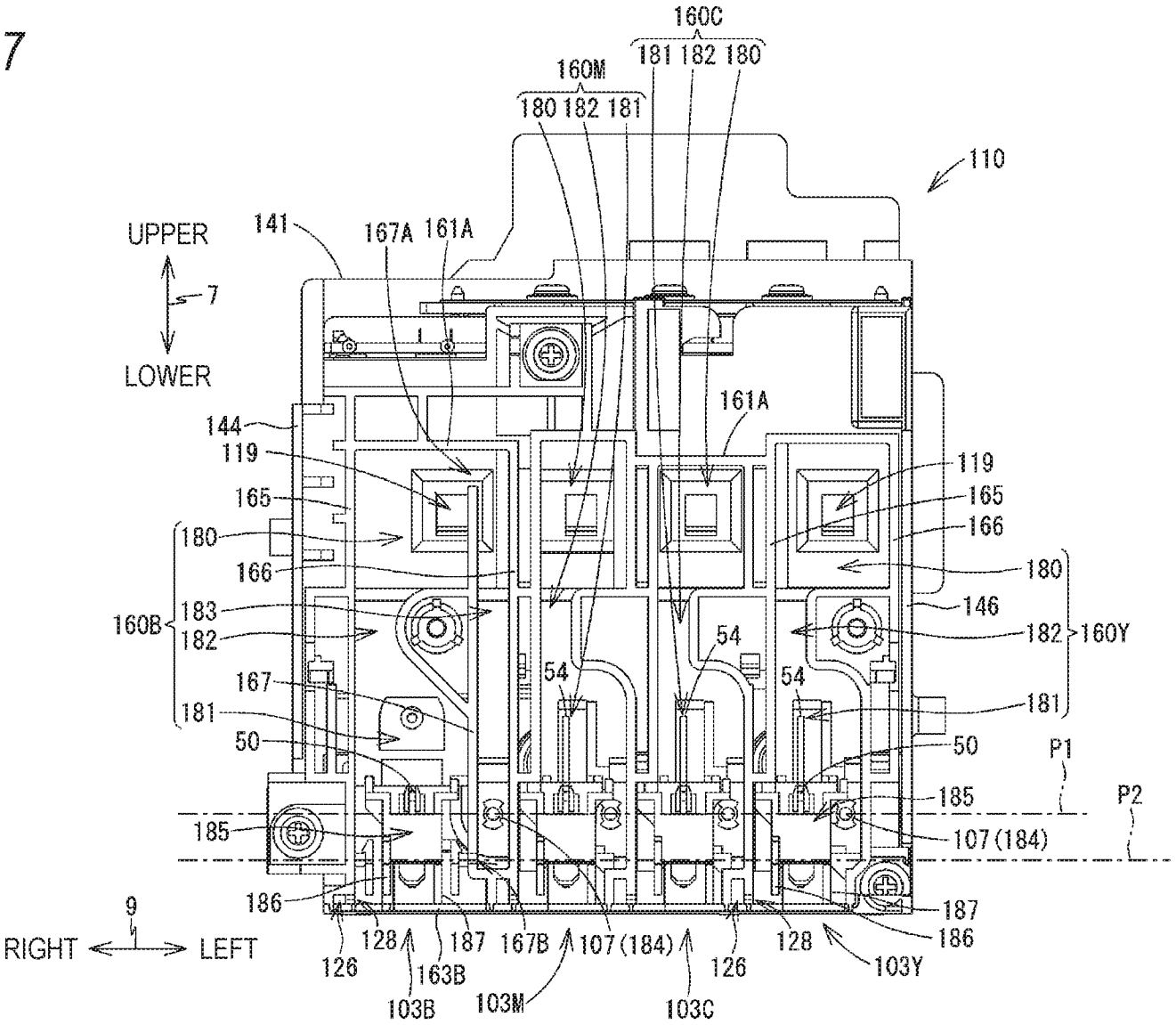
FIG. 7 is a sectional view taken along the line VII-VII of FIG. 6.

As illustrated in FIGS. 5 and 7, the installation case 110 includes four tanks 103B, 103M, 103C, and 103Y. The four tanks 103B, 103M, 103C, and 103Y are arranged in the right and left directions 9. The tanks 103B, 103M, 103C, and 103Y correspond to the ink cartridges 30 of each color. That is, the ink stored in the ink cartridges 30 of each color can circulate in the corresponding tanks 103B, 103M, 103C, and 103Y.

As illustrated in FIG. 6, the tanks 103 are located on the rear side of the back wall 143 of the installation case 101. As illustrated in FIG. 5, the tanks 103B, 103M, 103C, and 103Y have a box-like shape.

As illustrated in FIGS. 5 to 7, each of the tanks 103B, 103M, 103C, and 103Y includes a body that has a box-like shape and contains a liquid chamber 160 (which is an example of a second liquid chamber) to be described below and a joint 107. As illustrated in FIGS. 6 and 7, the body includes an upper wall 161, a front wall 162, a lower wall 163, a rear wall 164, a pair of side walls 165 and 166, and an upper wall 120B and a front wall 120C forming a projection 120.

As illustrated in FIG. 6, the upper wall 161 includes a first upper wall 161A and a second upper wall 161B. The first upper wall 161A is located above the second upper wall 161B.

The front wall 162 includes a first front wall 162A, a second front wall 162B, and a third front wall 162C. The first front wall 162A is located on the front side of the second front wall 162B. The third front wall 162C is located on the front side of the first front wall 162A.

The lower wall 163 includes a first lower wall 163A and a second lower wall 163B. The first lower wall 163A is located above the second lower wall 163B.

The first front wall 162A extends downwards from the front end of the first upper wall 161A. The first lower wall 163A extends backwards from the lower end of the first front wall 162A. The second front wall 162B extends downwards from the rear end of the first lower wall 163A. The upper wall 120B extends frontwards from the lower end of the second front wall 162B. The front wall 120C extends downwards from the front end of the upper wall 120B. The second upper wall 161B extends frontwards from the lower end of the front wall 120C. The third front wall 162C extends downwards from the front end of the second upper wall 161B. The second lower wall 163B extends backwards from the lower end of the third front wall 162C.

As illustrated in FIG. 7, the side wall 165 is connected to the upper wall 161, the front wall 162, and the right end of the lower wall 163 corresponding to the tanks 103B, 103M, 103C, and 103Y. The side wall 166 is connected to the upper wall 161, the front wall 162, and the left end of the lower wall 163 corresponding to the tanks 103B, 103M, 103C, and 103Y.

The rear wall 164 is a film welded to the first upper wall 161A, the second lower wall 163B, and the rear end surfaces of the side walls 165 and 166. In FIG. 5, the rear wall 164 (the film) is not illustrated. In the embodiment, the rear wall 164 is the film, but the walls other than the rear wall 164 may be films. The rear wall 164 may be a resin wall rather than the film.

As illustrated in FIG. 6, the joint 107 is connected to an ink supply tube 34 of the ink cartridge 30 installed in the installation case 110. Thus, the joint 107 communicates with a liquid chamber 57 that stores the ink in the ink cartridge 30. As a result, the ink stored in the ink cartridge 30 can circulate to the liquid chamber 160 via the joint 107. That is, the liquid chamber 160 stores the ink supplied from the ink supply tube 34 connected to the joint 107. The detailed configurations of the joint 107 and the liquid chamber 160 will be described below.

[Joint 107]

The joint 107 is located in each tank 103. Each joint 107 has common configuration. Therefore, the configuration of one joint 107 among the four joints 107 will be described below. The description of the three remaining joints 107 will be omitted. As illustrated in FIG. 4A, the joint 107 includes the hollow ink needle 102 and a guide unit 105.

As illustrated in FIG. 4A, the ink needle 102 is formed of a tubular resin and is located in the lower portion of the back wall 143 of the installation case 101. The ink needle 102 is located at a position corresponding to the ink supply tube 34 of the ink cartridge 30 installed in the installation case 110 on the back wall 143 of the installation case 101. The ink needle 102 protrudes frontwards from the back wall 143 of the installation case 101. An inner space 117 of the ink needle 102 is an example of a third flow path. An opening 116 at a protrusion distal end (the right end in FIG. 6) of the ink needle 102 is an example of one end of the third flow path.

The guide unit 105 is located around the ink needle 102, and thus has a cylindrical shape. The guide unit 105 protrudes frontwards from the back wall 143 of the installation case 101 and a protrusion end (front end) of the guide unit 105 is opened. The ink needle 102 is disposed at the center of the guide unit 105. The guide unit 105 has a shape in which the ink supply tube 34 of the ink cartridge is entered inward.

The joint 107 is not connected to the ink supply tube 34 of the ink cartridge 30 in a state in which the ink cartridge 30 is not installed in the installation case 110. Conversely, while the ink cartridge 30 is inserted into the installation case 110, that is, while the ink cartridge 30 is moved to the mounting position (the position illustrated in FIG. 6), the ink supply tube 34 of the ink cartridge 30 enters the guide unit 105. Further, when the ink cartridge 30 is entered into the installation case 110, as illustrated in FIG. 6, the ink needle 102 enters the ink supply port 71 formed in the ink supply tube 34 in the front and rear directions 8. Accordingly, the joint 107 and the ink supply tube 34 are connected to each other. Then, the ink stored in the liquid chamber 33 formed inside the ink cartridge 30 flows in the tank 103 via an ink valve chamber 35 formed inside the ink supply tube 34 and the inner space of the ink needle 102. The distal end of the ink needle 102 may be flat or may be sharp.

A valve 114 and a coil spring 115 are located in the inner space 117 of the ink needle 102. The valve 114 is moved in the front and rear directions 8 to block and open the opening 116 formed at the protrusion distal end of the ink needle 102. That is, the valve 114 blocks and opens the inner space 117 of the ink needle 102. The coil spring 115 urges the valve 114 frontward. Accordingly, in a state in which an external force is not applied (a state in which the ink cartridge 30 is not installed in the installation case 110), the valve 114 blocks the opening 116. In the state in which an external force is not applied, the front end of the valve 114 urged by the coil spring 115 protrudes forward than the opening 116. While the joint 107 and the ink supply tube 34 are connected to each other, the valve 114 opens the opening 116. An operation in which the valve 114 opens the opening 116 will be described later.

[Overview of Liquid Chamber 160]

The multi function device 10 includes four liquid chambers 160B, 160M, 160C, and 160Y corresponding to the tanks 103B, 103M, 103C, and 103Y, respectively.

In the following description, four liquid chambers are collectively referred to as the liquid chambers 160. The liquid chamber included in the tank 103B, that is, the liquid chamber storing the black ink, is referred to as the liquid chamber 160B. The liquid chamber included in the tank 103M, that is, the liquid chamber storing the magenta ink, is referred to as the liquid chamber 160M. The liquid chamber included in the tank 103C, that is, the liquid chamber storing the cyan ink, is referred to as the liquid chamber 160C. The liquid chamber included in the tank 103Y, that is, the liquid chamber storing the yellow ink, is referred to as the liquid chamber 160Y.

The configurations of the three liquid chambers 160M, 160C, and 160Y are substantially common. However, the configuration of the liquid chamber 160B is different from the three liquid chambers 160M, 160C, and 160Y. Accordingly, the configurations of the three liquid chambers 160M, 160C, and 160Y will be first described. Next, the configuration of the liquid chamber 160B will be described.

In the embodiment, the configurations of the liquid chambers 160M, 160C, and 160Y are substantially common and the configuration of the liquid chamber 160B is different from those of the liquid chambers 160M, 160C, and 160Y, but the difference in the configuration of the liquid chamber 160B is not limited to the above-described difference. For example, the configurations of the liquid chambers 160M, 160C, and 160Y may be the same as the configuration of the liquid chamber 160B. For example, the configuration of the liquid chamber 160B may be the same as the configurations of the liquid chambers 160M, 160C, and 160Y. For example, the configuration of the liquid chamber 160M may be the same as the configuration of the liquid chamber 160B. On the other hand, the configurations of the liquid chambers 160C and 160Y may be different from the configuration of the liquid chamber 160B.

[Liquid Chambers 160M, 160C, and 160Y]

Since the configurations of the liquid chambers 160M, 160C, and 160Y are common, the configuration of the liquid chamber 160Y which is one of the three liquid chambers 160M, 160C, and 160Y will be described below. The configurations of the remaining two liquid chambers 160M and 160C will be described as necessary.

As illustrated in FIGS. 5 to 7, the liquid chamber 160Y includes a buffer space 180, a first space 181, and a second space 182.

The buffer space 180 is demarcated by the first upper wall 161A, the first front wall 162A, the first lower wall 163A, the rear wall 164, and the side walls 165 and 166.

The first space 181 is demarcated by the second upper wall 161B, the third front wall 162C, the second lower wall 163B, the rear wall 164, and the side walls 165 and 166.

The second space 182 is demarcated by the second front wall 162B, the rear wall 164, and the side walls 165 and 166.

As illustrated in FIG. 7, a lower portion of the right end of the first space 181 of the liquid chamber 160Y is demarcated by the side wall 166 demarcating the left end of the right adjacent liquid chamber 160C. A portion other than the lower portion of the right end of the first space 181 of the liquid chamber 160Y is demarcated by the side wall 165. Right ends of the buffer space 180 and the second space 182 of the liquid chamber 160Y are demarcated by the side wall 165.

The buffer space 180 is located above the second space 182. The first space 181 is located below the second space 182. The upper end of the second space 182 communicates with the buffer space 180. The lower end of the second space 182 communicates with the first space 181. That is, the second space 182 is connected to the buffer space 180 and the first space 181.

The upper end of the second space 182 communicates with the right end of the buffer space 180. The lower end of the second space 182 communicates with the right end of the first space 181.

As illustrated in FIG. 6, the upper end of the second space 182 communicates with the rear end of the buffer space 180. The lower end of the second space 182 communicates with the rear end of the first space 181.

The protrusion 120 is located above the first space 181 and on the front side of the second space 182. In the protrusion 120, the side wall in the right and left directions 9 has transmittance. An inner space of the protrusion 120 continues in the first space 181 and the second space 182. The inner space of the protrusion 120 forms a part of the liquid chamber 160Y. An arm 53 and a detection object 54 of an actuator 50 to be described below are located in the inner space of the protrusion unit 120. The protrusion 120 may continue with only one of the first space 181 and the second space 182.

A communication port 184 is located in the third front wall 162C. The communication port 184 is connected to the first space 181. The first space 181 communicates with the inner space of the ink needle 102 of the joint 107 via the communication port 184. Thus, the ink flowing from the ink cartridge 30Y via the ink needle 102 flows in the liquid chamber 160Y to be stored in the liquid chamber 160Y. The communication port 184 is an example of the other end of the third flow path.

In a state in which an amount of ink for which the same height as the communication port 184 is a liquid level is stored in the liquid chamber 160Y, the buffer space 180 is located above the liquid level. The fact that the same height as the communication port 184 is the liquid level means that the same height as an axis center of the ink needle 102 (in other words, the center of the communication port 184) is a liquid level and means that the same height as the center of the ink supply port 71 is a liquid level. Specifically, a position P1 (which is an example of a specific position) indicated by a dot and dash line in FIG. 6 is the liquid level.

The fact that the same height as the communication port 184 is the liquid level is not limited to the fact that the position P1 serves as the liquid level. For example, the fact that the same height as the communication port 184 is the liquid level may mean that the same height as the upper end or the lower end of the communication port 184 is the liquid level.

As illustrated in FIG. 7, the liquid chamber 160Y communicates with an ink flow path 126 via the communication port 128. In the embodiment, the first space 181 communicates with the ink flow path 126 via the communication port 128. The communication port 128 is formed in the lower end of the side wall 166 demarcating the lower portion of the right end of the first space 181.

The communication port 128 is located below the communication port 184 of the joint 107 in the upper and lower directions 7.

As illustrated in FIG. 6, the communication port 128 is connected to the front end of the first space 181. That is, the communication port 128 is located at the front end of the side wall 166.

As illustrated in FIG. 5, the ink flow path 126 extends upwards from the front end of the tank 103 and continues with an ink outflow port 127. The ink tube 20 is connected to the ink outflow port 127. Thus, the liquid chamber 160Y communicates with the recording head 21 from the communication port 128 via the ink flow path 126 and the ink tube 20. That is, the ink stored in the liquid chamber 160Y flows from the communication port 128 to be supplied to the recording head 21 via the ink flow path 126 and the ink tube 20. The ink flow path 126 and the ink tube 20 are an example of a fourth passage. The communication port 128 is an example of one end of the fourth flow path. A connection portion 20A (see FIG. 2) of the ink tube 20 and the recording head 21 is an example of the other end of the fourth flow path.

The buffer space 180 communicates with the atmospheric communication port 124 (see FIGS. 4A and 4B) formed in the upper portion of the tank 103. The buffer space 180 and the atmospheric communication port 124 communicate with each other via a through hole 119 (see FIG. 6) formed in the first front wall 162A. The through hole 119 is sealed by a semi-permeable film 118. The atmospheric communication port 124, the through hole 119, the semi-permeable film 118, and an atmospheric flow path 147 (see FIG. 5) connecting the atmospheric communication port 124 to the through hole 119 are an example of a second communication portion. The atmospheric communication port 124 is opened to the outside. Thus, the liquid chamber 160Y is opened to the atmospheric air. That is, the atmospheric communication port 124 causes the liquid chamber 160Y to communicate with the atmospheric air. The atmospheric communication port 124 causes the liquid chamber 160Y communicate to the atmospheric air along a different passage from the atmospheric communication port 96 formed in the ink cartridge 30 to be described below. The atmospheric flow path 147 is an example of a fifth flow path. The through hole 119 is an example of one end of the fifth flow path. The atmospheric communication port 124 is an example of the other end of the fifth flow path.

In the tank 103, there are two atmospheric flow paths 147. One of the atmospheric flow paths 147 connects the atmospheric communication port 124 of the liquid chamber 160B to the through hole 119. The other of the atmospheric flow paths 147 connects the atmospheric communication port 124 of each of the liquid chambers 160M, 160C, and 160Y to the through hole 119. The configuration of the atmospheric flow path 147 is not limited to the above-described configuration. For example, only one atmospheric flow path 147 may be formed. The one atmospheric flow path 147 may connect the atmospheric communication port 124 of each of the liquid chambers 160B, 160M, 160C, and 160Y to the through hole 119.

[Liquid Chamber 160B]

Hereinafter, the configuration of the liquid chamber 160B will be described. In the description of the liquid chamber 160B, the detailed description of common configurations to the liquid chambers 160M, 160C, and 160Y will be omitted.

As illustrated in FIGS. 5 to 7, an inner wall 167 is formed in the liquid chamber 160B. The inner wall 167 is a wall stretching in the upper and lower directions 7 and the right and left directions 9. The inner wall 167 is located between the side walls 165 and 166 in the right and left directions 9. The front end of the inner wall 167 is connected to the front wall 162. The rear end of the inner wall 167 is connected to the rear wall 164. In other words, the rear wall 164 which is a film is welded to the rear end surface of the inner wall 167. In the embodiment, the inner wall 167 extends straightly in the upper and lower directions 7, but may not necessarily extend straightly. For example, the inner wall 167 may extend while being sloped in the upper and lower directions 7.

The liquid chamber 160B includes a third space 183 in addition to the three spaces (the buffer space 180, the first space 181, and the second space 182) forming the liquid chambers 160M, 160C, and 160Y. That is, the liquid chamber 160B includes the buffer space 180, the first space 181, the second space 182, and the third space 183.

The second space 182 is demarcated by the second front wall 162B, the rear wall 164, the side wall 165, and the inner wall 167.

The third space 183 is demarcated by the second front wall 162B, the rear wall 164, the inner wall 167, and the side wall 166. The third space 183 is located below the buffer space 180 and is located above the first space 181. The upper end of the third space 183 communicates with the buffer space 180. The lower end of the third space 183 communicates with the first space 181.

The upper end of the third space 183 communicates with the rear end of the buffer space 180. The lower end of the third space 183 communicates with the rear end of the first space 181. As illustrated in FIG. 7, the upper end of the third space 183 communicates with the left end of the buffer space 180. The lower end of the third space 183 communicates with the left end of the first space 181.

The third space 183 is located on the left side of the second space 182. The third space 183 is distant from the second space 182 due to the inner wall 167. That is, the third space 183 does not communicate with the second space 182. As described above, the third space 183 connects the buffer space 180 to the first space 181 on the left side of the second space 182.

The inner wall 167 divides the liquid chamber 160B in the right and left directions 9. The actuator 50 to be described below is disposed on the right side of the inner wall 167 in the liquid chamber 160B. The liquid chamber 160B is connected to the joint 107 via the communication port 184 on the left side of the inner wall 167 in the liquid chamber 160B. That is, the inner wall 167 demarcates the space between the joint 107 and the actuator 50 in the liquid chamber 160B.

The inner wall 167 is formed from the upper end and the lower end of the liquid chamber 160B. That is, the inner wall 167 is located from the buffer space 180 to the first space 181. Thus, the buffer space 180 is divided into two spaces in the right and left directions 9. The first space 181 is divided into two spaces in the right and left directions 9. There is a gap 167A at the upper end of the inner wall 167. Thus, the buffer space 180 divided into two spaces communicates with each other via the gap 167A. There is a gap 167B at the lower end of the inner wall 167. Thus, the first space 181 divided into two spaces communicates with each other via the gap 167B.

The inner wall 167 may be located from a position above the communication port 184 and the detection object 54 of the actuator 50 to be described below to a position below the communication port 184 and the detection object 54. That is, the inner wall 167 may not necessarily be located from the upper end to the lower end of the liquid chamber 160B. For example, the upper end of the inner wall 167 may be located below the position illustrated in FIG. 7.

As illustrated in FIG. 7, the communication port 128 is located on the right side of the inner wall 167 in the liquid chamber 160B. The communication port 128 is located below the gap 167B. The communication port 128 may be located on the left side of the inner wall 167 in the liquid chamber 160B. The communication port 128 may be located at the same position as the gap 167B in the upper and lower directions 7. The communication port 128 may be located above the gap 167B.

[Actuator 50]

As illustrated in FIG. 6, the actuator 50 is located inside the liquid chamber 160 of each tank 103. The actuator 50 is supported to be rotatable in directions of arrows 58 and 59 by a support member 185 disposed inside the liquid chamber 160. The actuator 50 may be supported by a member other than the support member 185.

The actuator 50 includes a float 51, a shaft 52, the arm 53, and the detection object 54.

The float 51 is located below the actuator 50. The float 51 is formed of a material with a lower specific gravity than the ink stored in the liquid chamber 160. The shaft 52 protrudes from a right surface and a left surface of the float 51 in the right and left directions 9. The shaft 52 is inserted into holes 191 formed in a right wall 186 and a left wall 187 of the support member 185. Thus, the actuator 50 is supported by the support member 185 to be rotatable about the shaft 52. The shaft 52 is located below the communication port 184 of the joint 107. The float 51 and the shaft 52 are located in the first space 181.

The arm 53 protrudes substantially upwards from the float 51. The detection object 54 is located at the protrusion distal end of the arm 53. That is, the detection object 54 is located at a rotation distal end of the actuator 50. A part of the arm 53 and the detection object 54 are located in the inner space 120A of the protrusion 120. The detection object 54 is located above the communication port 184 of the joint 107. The detection object 54 has a plate shape extending in the upper and lower directions 7 and the front and rear directions 8. The detection object 54 is formed of a material shielding light output from the light-emitting unit 55A of the liquid level sensor 55 to be described below.

When a liquid level of the ink stored in the liquid chamber 160 is located above the position P1 in the upper and lower directions 7, in other words, when a liquid level of the ink stored in the liquid chamber 33 of the ink cartridge 30 is above the position P1 of the ink supply tube 34 in the upper and lower directions 7, the actuator 50 is rotated toward an arrow 58 by buoyancy acting on the float 51. Thus, the actuator 50 is located at a detection position indicated by a solid line in FIG. 6.

On the other hand, the ink stored in the liquid chamber 160 and the ink valve chamber 35 is consumed and the liquid level of the ink is lowered to reach the position P1 in the upper and lower directions 7, the actuator 50 follows the liquid level and is rotated toward the arrow 59. Thus, the actuator 50 is located at a non-detection position indicated by a dotted line in FIG. 6. That is, the state of the actuator 50 is changed under the condition that the height of the liquid level of the ink stored in the liquid chamber 160 reaches the same position as the communication port 184 of the joint 107 in the upper and lower directions 7.

[Liquid Level Sensor 55]

The liquid level sensor 55 (see FIG. 6) detects the change in the state of the actuator 50 including the detection object 54. The liquid level sensor 55 includes a light-emitting unit and a light-receiving unit mounted on a substrate 60. The light-emitting unit and the light-receiving unit are located at an interval in the right and left directions 9 with the protrusion 120 of the tank 103 interposed therebetween. The light-emitting unit is located on one of the right and left sides of the protrusion 120. The light-receiving unit is located on the other of the right and left sides of the protrusion 120. A light passage of light emitted from the light-emitting unit matches the right and left directions 9. The detection object 54 of the actuator 50 at the detection position is located between the light-emitting unit and the light-receiving unit.

The liquid level sensor 55 outputs different detection signals in accordance with whether the light-receiving unit receives light output from the light-emitting unit. For example, the liquid level sensor 55 outputs a first signal. The first signal corresponds to a high-level signal (which refers to "a signal with a signal level equal to or greater than a threshold level") to the controller 130 under the condition that light output from the light-emitting unit is receivable in the light-receiving unit (that is, a light reception intensity is equal to or greater than a predetermined intensity). Conversely, the liquid level sensor 55 outputs a second signal. The second signal corresponds to a low-level signal (which refers to "a signal with a signal level less than the threshold level") to the controller 130 (see FIG. 9) under the condition that light output from the light-emitting unit is not receivable in the light-receiving unit (that is, a light reception intensity is less than the predetermined intensity).

The detection object 54 at the detection position is located between the light-emitting unit and the light-receiving unit. Accordingly, the detection object 54 at the non-detection position is located at an evacuation position from the position between the light-emitting unit and the light-receiving unit. Accordingly, when the liquid level of the ink stored in the liquid chamber 160 of the tank 103 (in other words, the liquid level of the ink stored in the liquid chamber 33 of the ink cartridge 30) is at a position equal to or below the position P1 in the upper and lower directions 7, light output from the light-emitting unit is not receivable in the light-receiving unit. Therefore, the liquid level sensor 55 outputs the first signal to the controller 130. It is noted that the first signal corresponds to the high-level signal. Conversely, when a liquid level of the ink stored in the liquid chamber 160 of the tank 103 (in other words, a liquid level of the ink stored in the liquid chamber 33 of the ink cartridge 30) is at a position above the position P1 in the upper and lower directions 7, light output from the light-emitting unit is not receivable in the light-receiving unit. Therefore, the liquid level sensor 55 outputs the second signal to the controller 130. It is noted that the second signal corresponds to the low-level signal.

[Ink Cartridge 30]

Figure 8:
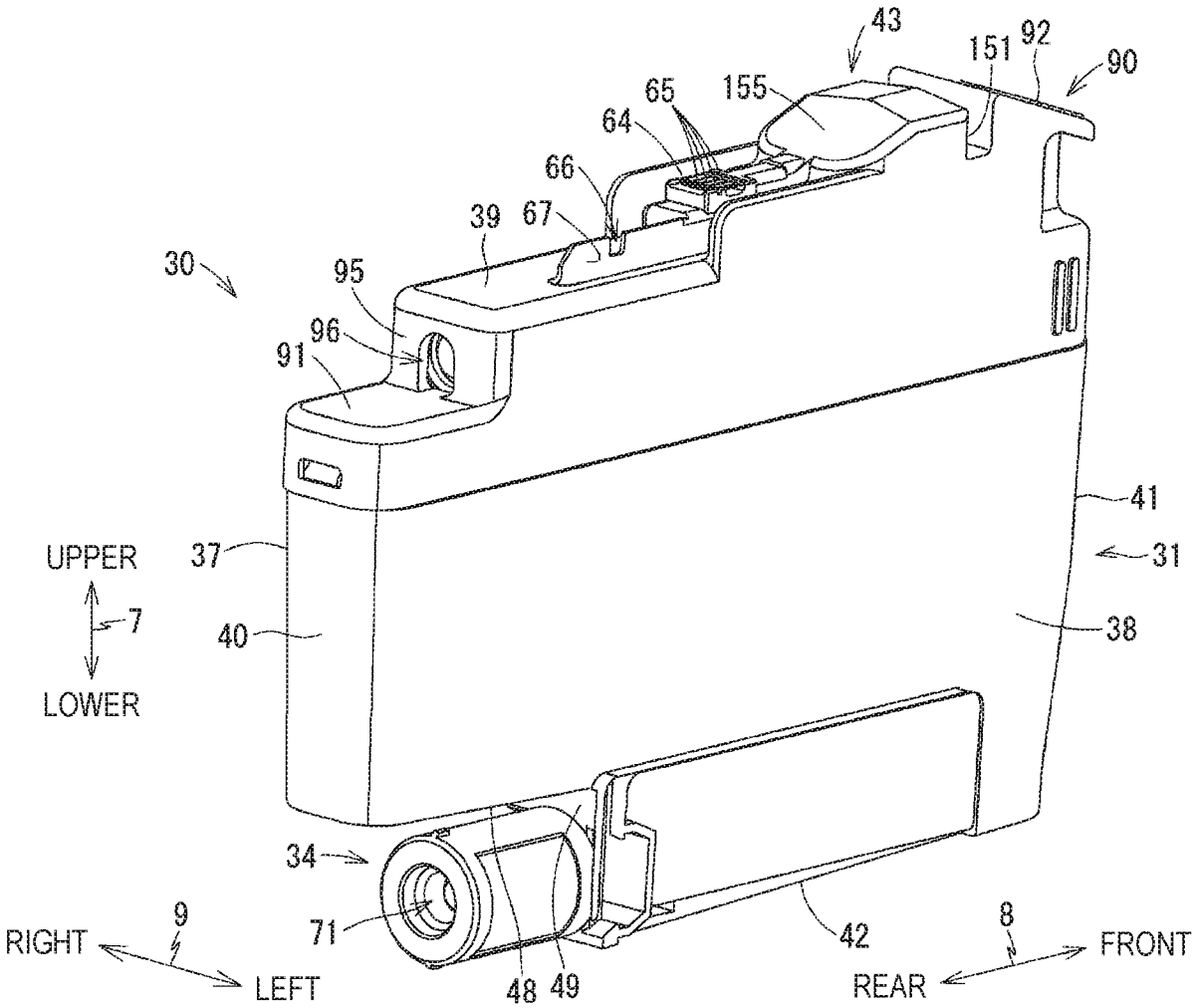
FIG. 8 is a front perspective view illustrating an ink cartridge 30.

The ink cartridge 30 illustrated in FIGS. 6 and 8 is a container that stores ink. An orientation of the ink cartridge 30 illustrated in FIGS. 6 and 8 is a usage orientation.

The ink cartridge 30 illustrated in FIG. 8 stores yellow ink. The ink cartridges 30 that store the cyan ink and the magenta ink have the same configuration as the ink cartridge 30 that stores the yellow ink except for presence or absence of a notch 66 to be described below or the position of the notch 66. The ink cartridge 30 that stores the black ink has the same configuration as the ink cartridges 30 that store the yellow ink, the cyan ink, and the magenta ink except for a length longer in the right and left directions 9 than the ink cartridges 30 that store the yellow ink, the cyan ink, and the magenta ink and the presence or absence of the notch 66 or the position of the notch 66. Accordingly, the configuration of the ink cartridge 30 that stores the yellow ink will be described below. The description of the configuration of the ink cartridges 30 that store the cyan ink, the magenta ink, and the black ink will be omitted.

As illustrated in FIGS. 6 and 8, the ink cartridge 30 has a casing 31 with a substantially rectangular shape. The casing 31 includes a rear wall 40, a stepped wall 49, a stepped wall 95, a front wall 41, an upper wall 39, a sub-supper wall 91, a lower wall 42, a sub-lower wall 48, a right wall 37, and a left wall 38.

The casing 31 has a flat shape that has dimensions thin in the right and left directions 9 and has dimensions in the upper and lower directions 7 and the front and rear directions 8 greater than dimensions in the right and left directions 9 as a whole. In the casing 31, at least the front wall 41 has transmittance so that a liquid level of the ink stored in the liquid chambers 32 and 33 can be viewed from the outside.

The sub-lower wall 48 is located above the lower wall 42 and extends frontwards to continue with the lower end of the rear wall 40. The rear end of the sub-lower wall 48 is located on the rear side of the rear end of the ink supply tube 34 and the front end of the sub-lower wall 48 is located on the front side of the rear end of the ink supply tube 34. The lower wall 42 and the sub-lower wall 48 continue by the stepped wall 49. The ink supply tube 34 extends backwards from the stepped wall 49 below the sub-lower wall 48 and above the lower wall 42. The rear end of the sub-lower wall 48 is located at any position. For example, the rear end of the sub-lower wall 48 may be located on the front side of the rear end of the ink supply tube 34.

A bulge 43 protruding upwards is formed on the outer surface of the upper wall 39. The bulge 43 extends in the front and rear directions 8. In the bulge 43, a surface facing backwards is a lock surface 151. The lock surface 151 is located above the upper wall 39. The lock surface 151 is a surface that can come into contact with the lock shaft 145 frontwards in a state in which the ink cartridge 30 is installed in the installation case 110. The lock surface 151 comes into contact with the lock shaft 145 frontwards so that the ink cartridge 30 is held on the installation case 110 against the urging force of the coil springs 78 and 98.

A sloped surface 155 is located on the rear side of the lock surface 151 of the bulge 43. While the ink cartridge 30 enters the installation case 110, the lock shaft 145 is guided along the sloped surface 155. Thus, the lock shaft 145 is guided to a position at which the lock shaft 145 comes into contact with the lock surface 151.

An operation portion 90 is located on the front side of the lock surface 151 on the upper wall 39. When an operation surface 92 of the operation portion 90 is pushed downwards in the state in which the ink cartridge 30 is installed in the installation case 110, the ink cartridge 30 is rotated and the lock surface 151 is then moved downwards. Thus, the lock surface 151 is located below the lock shaft 145. As a result, the ink cartridge 30 can be detached from the installation case 110.

The light-shielding plate 67 protruding upwards is located on the outer surface of the upper wall 39. The light-shielding plate 67 extends in the front and rear directions 8. The light-shielding plate 67 is located on the rear side of the bulge 43.

The light-shielding plate 67 is located between the light-emitting unit and the light-receiving unit of the installation sensor 113 in the state in which the ink cartridge 30 is installed in the installation case 110. Thus, the light-shielding plate 67 shields light of the installation sensor 113 traveling in the right and left directions 9. More specifically, when light output from the light-emitting unit of the installation sensor 113 arrives at the light-shielding plate 67 until arriving at the light-receiving unit, the intensity of light arriving at the light-receiving unit is less than a predetermined intensity, for example, becomes zero. The light-shielding plate 67 may completely shield the light from traveling of the light from the light-emitting unit to the light-receiving unit, may partially attenuate the light, may bend a traveling direction of the light, or may totally reflect the light.

The light-shielding plate 67 has the notch 66. The notch 66 is a notched space notched downwards from the upper end of the light-shielding plate 67 and extends in the front and rear directions 8. The notch 66 is located in the installation sensor 113, and thus the light output from the light-emitting unit of the installation sensor 113 is not shielded until the light arrives at the light-receiving unit. According to presence or absence of the notch 66, it is possible to determine a kind of ink cartridge 30, that is, a kind of ink stored in the ink cartridge 30, or an initial amount. Conversely, when the light-shielding plate 67 does not include the notch 66, the light-shielding plate 67 faces the light-emitting unit of the installation sensor 113 in the mounted ink cartridge 30.

An IC substrate 64 is located on the outer surface of the upper wall 39 and between the light-shielding plate 67 and the bulge 43 in the front and rear directions 8.

In the IC substrate 64, an IC chip (not illustrated in each drawing) and four electrodes 65 are mounted on a substrate formed of silicon or the like. The four electrodes 65 are arranged in the right and left directions 9. The IC chip is a semiconductor integrated circuit and information regarding the ink cartridge 30, for example, data indicating information such as a lot number, a date of manufacture and ink colors, is readably stored. In the IC substrate 64, the IC chip and the electrodes may be installed on a flexible substrate with flexibility.

Each electrode 65 is electrically connected to the IC. Each electrode 65 extends in the front and rear directions 8 and the four electrodes 65 are located to be separated in the right and left directions 9. Each electrode 65 is exposed to electrically access the upper surface of the IC substrate 64. The electrode 65 is electrically conducted with the contact 106 in the state in which the ink cartridge 30 is installed in the installation case 101. The controller 130 can read or write information from or on a memory of the IC chip via the contact 106 and the electrode 65.

Incidentally, the interface of the installation case 101 may be configured by a wireless interface, and the IC chip may be provided with a wireless interface. The wireless interface of the IC chip may be electrically connected to the memory of the IC chip. The wireless interface of the IC chip may be communicatable with the wireless interface of the installation case 101 wirelessly, in the state where the cartridge 30 is installed in the installation case 101, for example. The controller 130 may read-out/write information from/to the memory of the IC chip via the wireless interface of the IC chip and the wireless interface of the installation case 101.

The stepped wall 95 extends upwards from the front end of the sub-upper wall 91 which is at the rear end on the outer surface of the upper wall 39. The atmospheric communication port 96 causing the liquid chamber 32 to communicate with the atmospheric air is located on the stepped wall 95. That is, the atmospheric communication port 96 is located above the center of the dimension of the casing 31 in the upper and lower direction 7. The atmospheric communication port 96 is a substantially circular opening formed on the stepped wall 95 and has a larger inner diameter than an outer diameter of the rod 125 of the installation case 110.

As illustrated in FIG. 6, the rod 125 enters the atmospheric communication port 96 while the ink cartridge 30 enters the installation case 110. The rod 125 entering the atmospheric communication port 96 moves the valve 97 sealing the atmospheric communication port 96 backwards against the urging force of the coil spring 98. When the valve 97 is moved backwards and becomes distant from the atmospheric communication port 96, the liquid chamber 32 is opened to the atmospheric air. A member sealing the atmospheric communication port 96 is not limited to the valve 97. For example, the atmospheric communication port 96 may be sealed by a seal which can be peeled from the stepped wall 95.

As illustrated in FIG. 6, the liquid chamber 57 (which is an example of a first liquid chamber) storing the ink and an atmospheric flow path 61 in which the atmospheric air circulates are located inside the casing 31. The liquid chamber 57 includes the liquid chamber 32, the liquid chamber 33, and the ink valve chamber 35.

The casing 31 includes a partition wall 44 and a lower wall 45 therein. The partition wall 44 and the lower wall 45 are walls stretching the front and rear directions 8 and the right and left directions 9, respectively. The partition wall 44 and the lower wall 45 face each other in the upper and lower directions 7.

In the liquid chamber 32, an upper side is demarcated by the lower surface of the partition wall 44 and a lower side is demarcated by the upper surface of the lower wall 45 and the sub-lower wall 48. In the liquid chamber 32, a rear side is demarcated by the inner surfaces of the rear wall 40 and the stepped wall 49 and a front side is demarcated by the inner surface of the front wall 41. Both the right and left sides of the liquid chamber 32 is demarcated by the inner surfaces of the side walls 37 and 38. That is, the liquid chamber 32 is a space demarcated by the lower surface of the partition wall 44, the upper surface of the lower wall 45 and the sub-lower wall 48, the inner surfaces of the rear wall 40 and the stepped wall 49, the inner surface of the front wall 41, and the inner surfaces of the side walls 37 and 38.

The partition wall 44 separates the liquid chamber 32 from the atmospheric flow path 61. A through hole 46 is formed at the front end of the partition wall 44. The liquid chamber 32 and the atmospheric flow path 61 communicate with each other through the through hole 46.

The lower wall 45 extends frontwards from the inner surface of the stepped wall 49. The lower wall 45 divides the liquid chamber 57 into the liquid chamber 32 above the lower wall 45 and the liquid chamber 33 below the lower wall 45. A gap 45A is formed at the front end of the lower wall 45. The liquid chambers 32 and 33 communicate with each other through the gap 45A.

As illustrated in FIG. 6, the lower wall 45 is located above the ink supply port 71.

The liquid chamber 33 is located below the liquid chamber 32 at the usage orientation in the inner space of the casing 31 and stores the ink. A volume of the liquid chamber 33 which can store the ink is less than a volume of the liquid chamber 32 which can store the ink.

In the liquid chamber 33, an upper side is demarcated by the lower surface of the lower wall 45 and a lower side is demarcated by the inner surface of the lower wall 42. In the liquid chamber 33, a front side is demarcated by the inner surface of the front wall 41. In the liquid chamber 33, right and left sides are demarcated by the inner surfaces of the side walls 37 and 38. A partition wall 47 is formed between the liquid chamber 33 and the ink valve chamber 35. The rear side of the liquid chamber 33 is demarcated by the front surface of the partition wall 47. That is, the liquid chamber 33 is a space demarcated by the lower surface of the lower wall 45, the inner surface of the lower wall 42, the inner surface of the front wall 41, the inner surfaces of the side walls 37 and 38, and the front surface of the partition wall 47. The liquid chamber 33 communicates with the ink valve chamber 35 through a through hole 99 formed in the partition wall 47.

One end of the atmospheric flow path 61 communicates with the liquid chamber 32 through the through hole 46. The other end of the atmospheric flow path 61 communicates with the outside through the atmospheric communication port 96. The atmospheric flow path 61 is an example of a second flow path. The through hole 46 is an example of one end of the second flow path. The atmospheric communication port 96 is an example of the other end of the second flow path.

An atmospheric valve chamber 36 is located at the other end of the atmospheric flow path 61. The valve 97 and the coil spring 98 are located in the atmospheric valve chamber 36. The atmospheric valve chamber 36 communicates with the outside through the atmospheric communication port 96.

The valve 97 can move between a closed position at which the atmospheric communication port 96 is sealed and an open position distant from the atmospheric communication port 96. The coil spring 98 is extendable in the front and rear directions 8 and urges the valve 97 in a direction at which the valve 97 comes into contact with the atmospheric communication port 96, that is, the backward side. A spring constant of the coil spring 98 is less than a spring constant of a coil spring 78 of the ink supply tube 34.

A through hole 94 is located in the wall 93 demarcating the atmospheric valve chamber 36. The atmospheric valve chamber 36 communicates with one end of the atmospheric flow path 61 through the through hole 94. The through hole 94 is sealed by a semi-permeable film 80.

The ink supply tube 34 protrudes backwards from the stepped wall 49. That is, the ink supply tube 34 is located in the stepped wall 49. The ink supply tube 34 has an outer cylindrical shape. An inner space of the ink supply tube 34 is the ink valve chamber 35. The rear end of the ink supply tube 34 is opened to the outside of the ink cartridge 30 through the ink supply port 71. A packing 76 is located at the rear end of the ink supply tube 34. The front end of the ink supply tube 34 communicates with the lower end of the liquid chamber 33 through the through hole 99, as described above. That is, the ink supply tube 34 communicates with the lower end of the liquid chamber 33. As described above, the ink supply port 71 is connected to the liquid chamber 33 through the ink valve chamber 35. The ink valve chamber 35 is an example of a first flow path. The through hole 99 is an example of one end of the first flow path. The ink supply port 71 is an example of the other end of the first flow path.

The ink valve chamber 35 is demarcated by the inner surface of the ink supply tube 34. The lower end 34A of the inner surface of the ink supply tube 34 demarcates the bottom (lowermost end) of the liquid chamber 57. On the other hand, the bottom (lowermost end) of the liquid chamber 160 of the tank 103 is demarcated by the upper surface of the second lower wall 163B. Then, the upper surface of the second lower wall 163B is located below the lower end 34A of the inner surface of the ink supply tube 34.

A valve 77 and the coil spring 78 are located in the ink valve chamber 35. The valve 77 is moved in the front and rear directions 8 to open and close the ink supply port 71 formed through the center of the packing 76. The coil spring 78 urges the valve 77 backwards. Accordingly, in a state in which an external force is not applied, the valve 77 closes the ink supply port 71 of the packing 76.

The packing 76 is a discoid member in which a through hole is formed in its center. The packing 76 is formed of, for example, an elastic material such as rubber or elastomer. The center of the packing 76 is formed through in the front and rear directions 8 so that an inner circumferential surface with a cylindrical shape is formed and the ink supply port 71 is formed by the inner circumferential surface. The inner diameter of the ink supply port 71 is slightly less than the outer diameter of the ink needle 102.

When the ink cartridge 30 is installed in the installation case 110 in a state in which the valve 77 closes the ink supply port 71 and the valve 114 closes the opening 116 of the ink needle 102, the ink needle 102 enters the ink supply port 71 in the front and rear directions 8 during the installation of the ink cartridge 30. That is, the joint 107 and the ink supply tube 34 are connected to each other. At this time, the outer circumferential surface of the ink needle 102 comes into contact with the inner circumferential surface demarcating the ink supply port 71 in a liquid tight manner while the packing 76 is elastically deformed. When the distal end of the ink needle 102 passes through the packing 76 and enters the ink valve chamber 35, the distal end of the ink needle 102 comes into contact with the valve 77. By further inserting the ink cartridge 30 into the installation case 110, the ink needle 102 moves the valve 77 backwards against the urging force of the coil spring 78. Thus, the ink supply port 71 is opened.

While the distal end of the ink needle 102 comes into contact with the valve 77, the valve 77 comes into contact with the valve 114 from the front side to press the valve 114. Then, the valve 114 is moved backwards against the urging force of the coil spring 115. Thus, the opening 116 is opened. As a result, the ink stored in the liquid chambers 32 and 33 and the ink valve chamber 35 can circulate in the liquid chamber 160 of the tank 103 via the inner space 117 of the ink needle 102. Here, the liquid chambers 32 and 33, the ink valve chamber 35, and the liquid chamber 160 are all opened to the atmospheric air. Accordingly, the ink stored in the liquid chamber 32, the liquid chamber 33, and the ink valve chamber 35 of the ink cartridge 30 is supplied to the liquid chamber 160 of the tank 103 through the ink supply tube 34 by a water head difference. When the ink is supplied, a liquid level of the ink reaches the same position as the liquid chamber 160 and the liquid chamber 32 in the upper and lower directions 7.

[Controller 130]

Hereinafter, an overall configuration of the controller 130 will be described with reference to FIG. 9. The controller 130 controls an operation of the whole multi function device 10. The controller 130 includes a CPU 131, a ROM 132, a RAM 133, an EEPROM 134, an ASIC 135, and an internal bus 137 connecting these units to each other.

The ROM 132 stores a program or the like used for the CPU 131 to control various operations including recording control. The RAM 133 is used as a memory region that temporarily stores data, a signal, and the like used when the CPU 131 executes the program. The EEPROM 134 stores setting, a flag, and the like retained even after power is turned off.

The transport motor 171, the feeding motor 172, and the carriage driving motor 173 are connected to the ASIC 135. A driving circuit controlling each motor is embedded in the ASIC 135. When a driving signal for rotating each motor is input from the CPU 131 to the driving circuit for a predetermined motor, a driving current suitable for the driving signal is output from the driving circuit to a corresponding motor. Thus, the corresponding motor is rotated. That is, the controller 130 controls the motors 171, 172, and 173.

The piezoelectric elements 56 are connected to the ASIC 135. The piezoelectric elements 56 operate when power is fed by the controller 130 via a drive circuit (not illustrated). The controller 130 controls feeding of power to the piezoelectric elements 56 such that ink droplets can be selectively discharged from the plurality of nozzles 29.

The controller 130 performs an image recording process when an image recording instruction is input to the printer 11. The image recording instruction may be received from an external apparatus via a communication interface (not illustrated) or may be received though a user input on a panel of the multi function device 10. When an image is recorded on the sheet 12 based on the image recording instruction, the controller 130 controls the transport motor 171 such that the pair of transport rollers 25 and the pair of discharging rollers 27 can perform an intermittent transport process of alternately repeating transporting and stopping of the sheet 12 equivalent to predetermined line feeding.

The controller 130 performs a discharging process while the sheet 12 is stopped in the intermittent transport process. The discharging process is a process of discharging ink droplets from the nozzles 29 by controlling feeding of power to the piezoelectric elements 56 while moving the carriage 22 in the right and left directions 9. The image is recorded on the sheet 12 by repeating the intermittent transport process and the discharging process.

A signal output from the installation sensor 113 is input to the ASIC 135. The controller 130 determines that the ink cartridge 30 is installed in the installation case 110 when the signal input from the installation sensor 113 enters a low level and access to the IC substrate 64 is subsequently possible. Conversely, the controller 130 determines that the ink cartridge 30 is not installed in the installation case 110 when the signal input from the installation sensor 113 enters a high level and access to the IC substrate 64 is subsequently not possible.

A signal output from the liquid level sensor 55 is input to the ASIC 135. When the signal input from the liquid level sensor 55 is at a low level, the controller 130 determines that a liquid level of the ink stored in the tank 103 and the ink cartridge 30 is located above the position P1.

On the other hand, when the signal input from the liquid level sensor 55 is changed from the low level to the high level because of a change in the state of the actuator 50, the controller 130 determines that the liquid level of the ink stored in the liquid chamber 160 of the tank 103 and the liquid chamber 57 of the ink cartridge 30 is located at the position P1 in the upper and lower directions 7. The fact that the liquid level of the ink is located at the position P1 in the liquid chamber 57 means that the ink may not flow from the liquid chamber 57. That is, it meant that the ink cartridge 30 becomes empty.

At this time, the controller 130 displays the fact that the ink stored in the ink cartridge 30 is empty, that is, it is necessary to replace the ink cartridge 30, on the display 200 (see FIG. 1), blinks an LED, or outputs a buzzer sound to activate the user that the ink stored in the ink cartridge 30 is empty.

The controller 130 starts counting an amount of ink discharged from the recording head 21 by setting a time point at which the signal input from the liquid level sensor 55 is changed from the low level to the high level as a base point. The discharging of the ink from the recording head 21 is, image recording, purging, flushing, or the like. An amount of ink discharged from the recording head 21 in the image recording can be counted from image data based on an image recording instruction. An amount of ink discharged from the recording head 21 in purging or flushing can be counted based on a purging instruction or a flushing instruction. The counting may be counting-up or counting-down. In the embodiment, the counting is assumed to be counting-up from an initial value, zero. Then, when a count value reaches a threshold Th1 in the discharging of the ink from the recording head 21 based on an image recording instruction, a purging instruction, or the like, it is determined that a liquid level of the ink stored in the tank 103 and the ink cartridge 30 is at a predetermined position below the position P1 in the upper and lower directions 7. A first threshold is determined in consideration of, for example, a liquid level of the ink at which the air does not enter the ink flow path 126 from the communication port 128 on the basis of the volume of the liquid chamber 160 below the communication port 184. The predetermined position is a position P2 (see FIGS. 6 and 7) in the upper and lower directions 7. That is, the predetermined position is a position above the communication port 128. The position P2 may be above or below the position indicated in FIGS. 6 and 7 under the condition that the position P2 is located below the position P1.

When the liquid level of the ink reaches the position P2, the controller 130 controls the recording unit 24, and specifically stops feeding power to the piezoelectric elements 56, such that the discharging of the ink droplets from the nozzles 29 is stopped. When the liquid level of the ink reaches the position P2, the controller 130 displays the fact that the ink stored in the second liquid chamber 160 is empty on the display 200 (see FIG. 1), blinks the LED, or outputs a buzzer sound to activate the user that the ink stored in the second liquid chamber 160 is empty.

[Notification Process]

Figure 10:
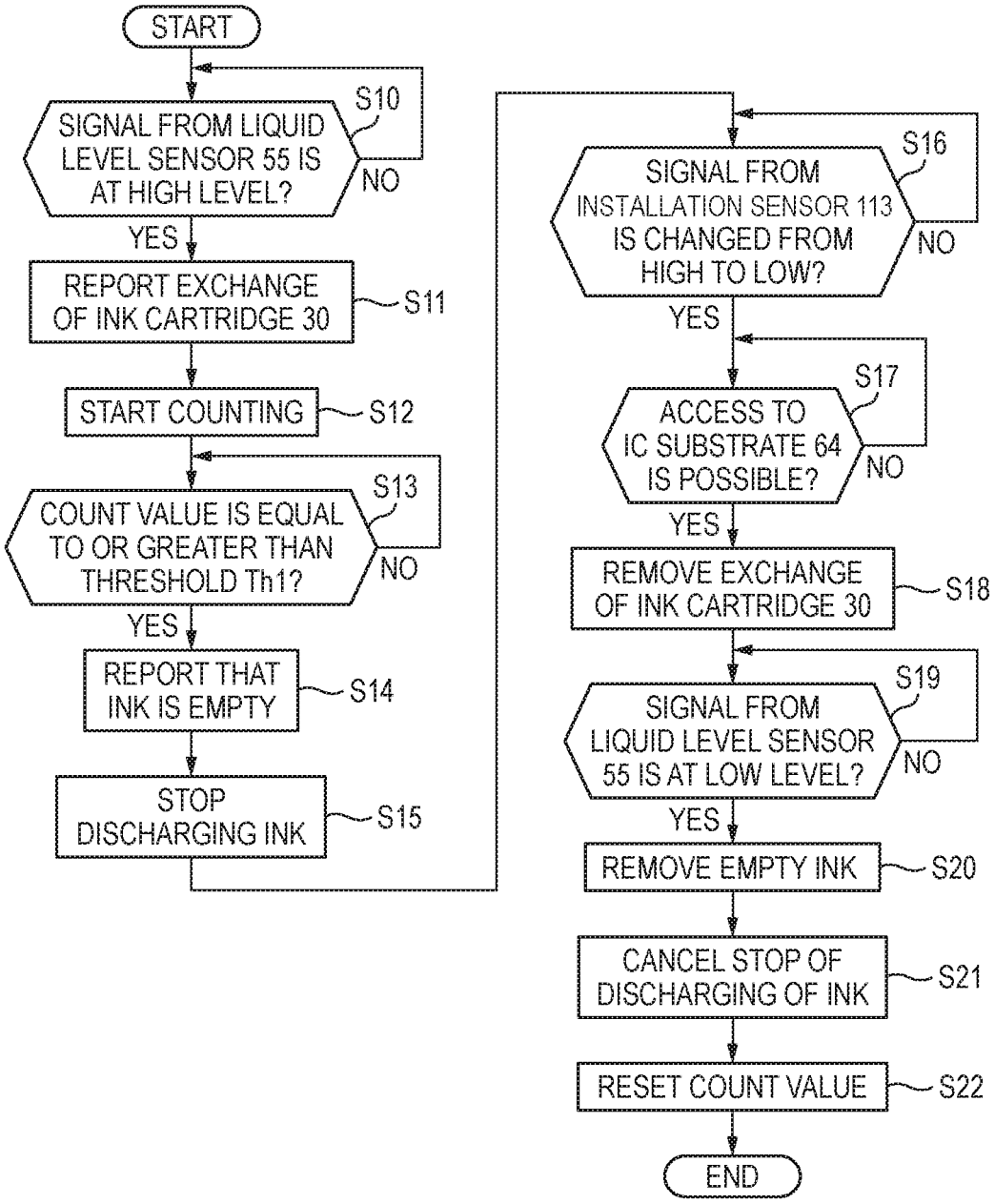
FIG. 10 is a flowchart illustrating a notification process by the controller 130.

Hereinafter, a notification process by the controller 130 according to the embodiment will be described with reference to the flowchart of FIG. 10. The notification process is performed on each of the four ink cartridges 30 and the corresponding tank 103. The notification process on one ink cartridge 30 and the corresponding tank 103 will be described as an example below without distinguishing the ink cartridges 30 from each other.

In an initial state, a count value to be described below is stored as zero in the RAM 133. The actuator 50 is located at the detection position. Thus, a signal with a low level is output from the liquid level sensor 55 to the controller 130. When the signal with the low level is received from the liquid level sensor 55, the controller 130 determines that the liquid level of the ink stored in the tank 103 and the ink cartridge 30 is located above the position P1.

When the image recording, the purging, and the flushing on the sheet 12 are performed, the ink is discharged from the nozzles 29 of the recording head 21. The ink is supplied from the liquid chamber 160 of the tank 103 and the liquid chamber 57 of the ink cartridge 30 to the recording head 21. Thus, the remaining amount of ink stored in the tank 103 and the ink cartridge 30 is reduced, and thus the liquid level of the ink in the liquid chamber 160 and the liquid level of the ink in the liquid chamber 57 are lowered. Basically, the liquid level of the ink in the liquid chamber 160 and the liquid level of the ink in the liquid chamber 57 match at the same position in the upper and lower directions 7.

When the liquid level of the ink in the liquid chambers 160 and 57 reaches a height equal to or less than the position P1, the actuator 50 is rotated from the detection position to the non-detection position. Thus, the liquid level sensor 55 outputs a signal with a high level. The controller 130 receives the signal with the high level from the liquid level sensor 55 (Yes in S10).

When the signal with the high level is received from the liquid level sensor 55, the controller 130 displays an indication "Replace ink cartridge" (which is an example of a first notification) on the display 200 (S11). The controller 130 starts counting a liquid amount of ink discharged from the recording head 21 (S12). The controller 130 counts up the count of the liquid amount of ink based on the image recording instruction, the purging instruction, and the like and stores an updated count value in the ROM 133, for example, after image recording equivalent to one page is performed or the purging or the flushing is completed.

At a timing at which the count value is stored in the RAM 133, the controller 130 determines whether the count value is equal to or greater than the threshold Th1. When the controller 130 determines the count value is equal to or greater than the threshold Th1 (Yes in S13), the controller 130 displays an indication "Ink becomes empty" (which is an example of a second notification) on the display 200

(S14). The controller 130 stops discharging the ink droplets from the nozzles 29 of the recording head 21 (S15).

The user can replace the ink cartridge 30 at any timing after the indication "Replace ink cartridge" is displayed on the display 200. Here, the following description will be made assuming that the user replaces the ink cartridge 30 after the indication "Ink becomes empty" is displayed on the display 200.

When the ink cartridge 30 is replaced by the user, a signal output by the installation sensor 113 is changed. Specifically, when the ink cartridge 30 is extracted from the installation case 101, the signal output by the installation sensor 113 is changed from the low level to the high level. Then, when the ink cartridge 30 is installed in the installation case 101, the signal output by the installation sensor 113 is changed from the high level to the low level.

When the signal with the high level is acquired from the installation sensor 113 and subsequently the signal with the low level is acquired (Yes in S16), the controller 130 determines whether the access to the IC substrate 64 is possible (S17). When the access to the IC substrate 64 is possible, the controller 130 removes the indication "Replace ink cartridge" from the display 200 (S18).

For example, when the ink cartridge 30 storing an initial charging amount of ink is installed in the installation case 101, the ink flows from the liquid chamber 57 of the ink cartridge 30 to the liquid chamber 160 of the tank 103 by a water head difference. Thus, the liquid level of the ink in the liquid chamber 160 of the tank 103 increases.

When the liquid level of the ink in the liquid chamber 160 reaches a height equal to or greater than the position P1, the actuator 50 is rotated from the non-detection position to the detection position. Thus, the liquid level sensor 55 outputs the signal with the low level. The controller 130 receives the signal with the low level from the liquid level sensor 55 (Yes in S19).

When the access to the IC substrate 64 is possible and subsequently the signal with the low level is received from the liquid level sensor 55, the controller 130 removes the indication "Ink becomes empty" from the display 200 (S20). The controller 130 cancels the stop of the discharging of the ink droplets from the nozzles 29 (S21). Then, the controller 130 updates the count value stored in the RAM 133 to the initial value (S22).

According to the above description, the printer 11 determines whether the position of the liquid level of the ink in the liquid chamber 57 of the ink cartridge 30 reaches the position P1 based on the signal output from the liquid level sensor 55, that is, reports determination of cartridge exchanging (S11) and starts counting the count value to determine whether the position of the liquid level of the ink in the liquid chamber 160 of the tank 103 reaches the position P2 (S12).

The liquid level sensor 55 outputs the signal when the liquid level of the ink in the liquid chamber 160 of the tank 103 reaches the position P1. Therefore, the initial value of the count value accurately corresponds to the fact that the liquid level of the ink reaches the position P1. Thus, it is possible to improve precision of the determination of whether the liquid level of the ink in the liquid chamber 160 reaches the position P2.

The position P1 and the communication port 184 of the tank 103 are the same positions in the upper and lower directions 7. Therefore, after the liquid level sensor 55 outputs the signal with the high level, the ink does not further flow from the liquid chamber 57 of the ink cartridge 30 to the liquid chamber 160 of the tank 103. Thus, it is possible to improve the precision of the determination of whether the liquid level of the ink in the liquid chamber 160 of the tank 103 reaches the position P2 based on the count value. The printer 11 can inform the user of "Replace ink cartridge" at a timing at which the ink may not further flow from the liquid chamber 57 of the ink cartridge 30.

When the count value is equal to or greater than the threshold Th1, the controller 130 stops discharging the ink from the recording head 21. Therefore, it is possible to suppress the air from flowing from the liquid chamber 160 of the tank 103 to the ink flow path 126.

Modification Examples

In the above-described embodiment, the actuator 50 and the liquid level sensor 55 are located in the tank 103, but the actuator 50 may be located in the liquid chamber 57 of the ink cartridge 30. A target detected by the liquid level sensor 55 is not limited to the detection object 54 of the actuator 50. For example, a prism may be disposed at the same height as the position P1 in each tank 103. Then, whether the liquid level of the ink stored in the liquid chamber 160 is equal to or less than the position P1 may be detected based on a difference in a traveling direction of light incident on the prism according to whether the liquid level of the ink stored in the liquid chamber 160 is above the prism, that is, based on a transmission state of light radiated to the prism.

For example, a light transmission portion may be formed by forming a portion with a height including at least the position P1 in a wall of the body of the liquid chamber 160 as a member with transmittance and an optical transmissive sensor may be located outside of the body of the liquid chamber 160. Then, according to whether the liquid level of the ink stored in the liquid chamber 160 is above a light transmission portion of a transmissive sensor, it may be detected that the liquid level of the ink stored in the liquid chamber 160 is equal to or less than the position P1 based on whether light incident on the light transmission portion of the wall of the body of the liquid chamber 160 transmits through the light transmission portion and arrives at the inside of the liquid chamber 160, transmits through the light transmission portion without being attenuated by the ink in the liquid chamber 160 and arrives at the light-receiving unit or is attenuated by the ink in the liquid chamber 160 and arrives at the light-receiving unit (is attenuated and may not arrive at the light-receiving unit), that is, based on an attenuation state of the light incident on the light transmission portion of the wall of the body of the liquid chamber 160.

For example, two electrodes may be located in the liquid chamber 160 of each tank 103. Two electrodes are mounted on the substrate 60. The lower end of one of the two electrodes is located slightly higher than the position P1. The lower end of the other of the two electrodes is located below the position P1. Then, based on whether a current flows through the ink between the two electrodes, it may be detected whether the liquid level of the ink stored in the liquid chamber 160 is equal to or less than the position P1.

Figure 11:
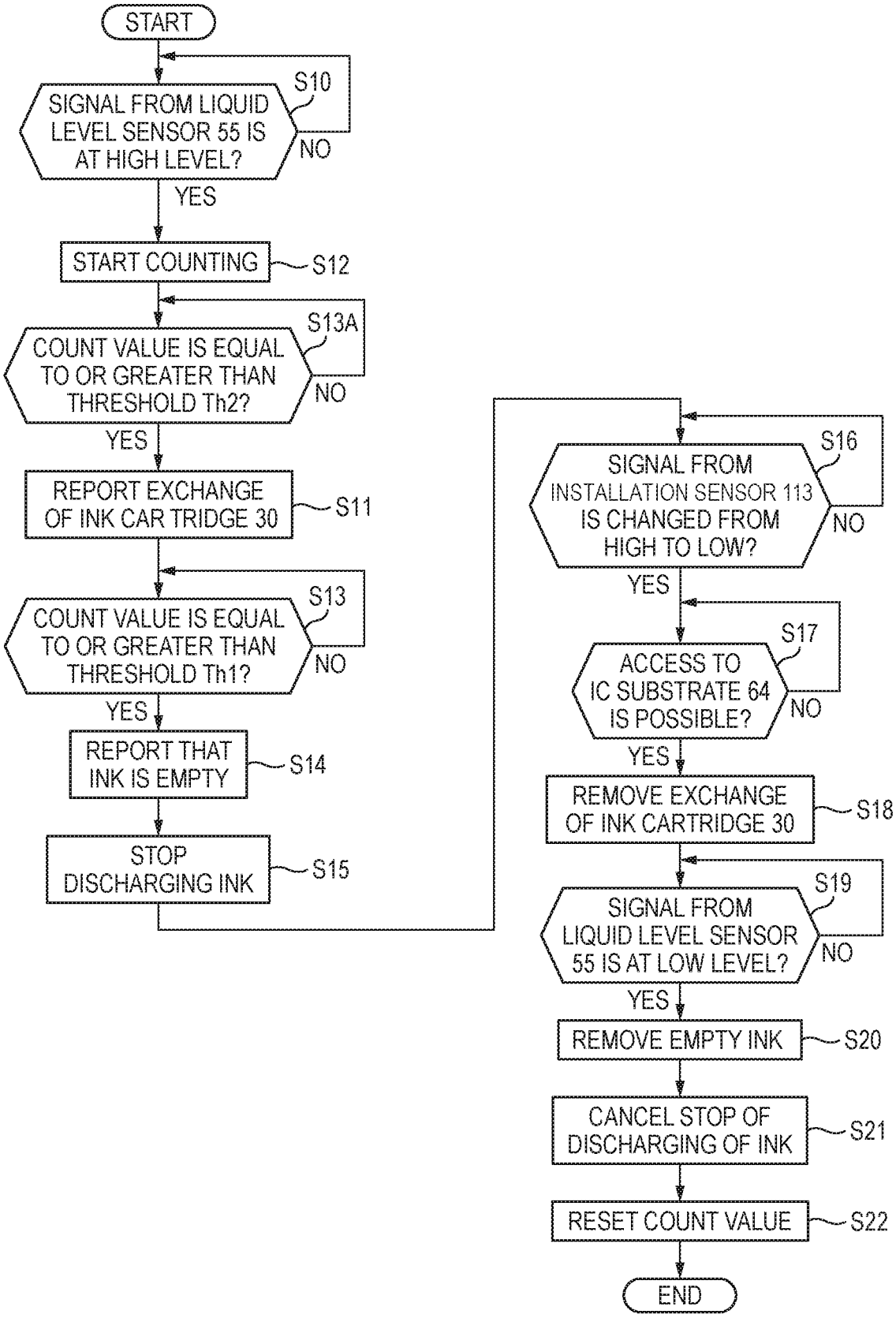
FIG. 11 is a flowchart illustrating another notification process by the controller 130.

The position P1 may not necessary be the same position as the communication port 184 of the tank 103 in the upper and lower directions 7 or may be above or below the communication port 184. For example, in a configuration in which the position P1 is above the communication port 184 of the tank 103, the controller 130 may start counting the count value (S12) when the signal with the high level is received from the liquid level sensor 55 (YES at S10) and may display the indication "Replace ink cartridge" on the display 200 (S11) when the count value reaches a threshold Th2 (YES at S13A as shown in FIG. 11). Here, the threshold Th2 is a value closest to the initial value than the threshold Th1. The count value reaches the threshold Th2 before reaching the threshold Th1. The threshold Th2 is determined in consideration of the volumes of the liquid chambers 32 and 160 from the position P1 to the position with the height of the communication port 184. Accordingly, when the count value reaches the threshold Th2, the liquid level of the ink is located between the position P2 and the position P1 above the communication port 184 in the tank 103 and the ink cartridge 30. By setting the threshold Th2 to a position at which the liquid level of the ink in the ink cartridge 30 is the communication port 184, the liquid level sensor 55 can output the signal with the high level and subsequently can display the indication "Replace ink cartridge" on the display 200 at an appropriate timing based on the count value. The appropriate timing may be immediately after the liquid level sensor 55 outputs the signal with the high level or may be a timing at which the count value reaches a predetermined threshold after the liquid level sensor 55 outputs the signal with the high level.

The present disclosure is not limited to the above-described embodiment and the configuration of the ink cartridge 30, the tank 103, or the like may be appropriately changed within the scope of the present disclosure without departing from the gist of the disclosure. For example, the configuration of the liquid chambers 32 and 33 in the ink cartridge 30, the configuration of the ink supply tube 34, or the configuration in which the atmospheric flow path 61 or the atmospheric communication port 96 is opened and closed may be changed to a known configuration. The configuration of the liquid chamber 160 in the tank 103 or the configuration of the ink needle 102, the atmospheric flow path 147, or the like may be changed to a known configuration.

In the foregoing embodiment, the ink cartridge 30 is inserted to the installation case 101 in the horizontal direction to be installed in the installation case 101. However, the ink cartridge 30 may be inserted to the installation case 101 in, for example, the upper and lower directions 7 other than the horizontal direction to be installed in the installation case 101.

In the foregoing embodiment, the joint 107 and the ink supply tube 34 extend in the horizontal direction, but may extend in a direction other than the horizontal direction. For example, the joint 107 may protrude upwards from the installation case 101. The ink supply tube 34 may protrude downwards from the lower wall of the ink cartridge 30. In this case, as the position P1, for example, a central position of the joint 107 in the upper and lower direction 7 or a central position of the ink supply tube 34 in the upper and lower directions 7 is set.

In the foregoing embodiment, the ink has been described as an example of a liquid. For example, a preprocessing liquid discharged to a sheet or the like earlier than ink at the time image recording may be stored in the ink cartridge 30 or the tank 103 instead of the ink. Water for cleaning the recording head 21 may be stored in the cartridge 30 or the tank 103.

According to an aspect (1) of the present disclosure, there is provided an image recording apparatus including: an installation case that receives a cartridge, the cartridge including: a first liquid chamber which stores a liquid; a first flow path which includes one end communicating with the first liquid chamber and the other end communicating with an outside; and a second flow path which includes one end communicating with the first liquid chamber and the other end communicating with the outside; a tank that includes: a second liquid chamber; a third flow path which includes one end communicating with the outside and the other end communicating with the second liquid chamber, at least one of the first flow path and the third flow path configured to communicate with the first chamber of the cartridge installed in the installation case and the second chamber; a fourth flow path which is below the third flow path in a vertical direction and communicates with the second liquid chamber; and a fifth flow path which includes one end communicating with the second liquid chamber and the other end communicating with the outside; a sensor; a head that communicates with the other end of the fourth flow path; a notification device; and a controller. The controller is configured to: receive a first signal from the sensor, the first signal output by the sensor in response to a liquid level in one of the first liquid chamber and the second liquid chamber being equal to or below a specific position, the specific position being equal to or above the other end of the third flow path; control the notification device to activate a first notification indicating the cartridge in response to receiving the first signal from the sensor; receive a discharging instruction to discharge the liquid via the head; count a count value indicating an amount of liquid instructed to be discharged with the discharging instruction in response to receiving the discharging instruction after receiving the first signal from the sensor; determine whether the count value reaches a first threshold; and control, in response to determining that the count value reaches the first threshold, the notification device to activate a second notification different from the first notification. At the notification device activating the second notification, the liquid level of the second chamber is between the other end of the third flow path and the one end of the fourth flow path in the vertical direction.

In the foregoing configuration, the count value can start to be counted to determine whether the liquid level of the liquid in the first liquid chamber reaches the specific position and determine whether the liquid level of the liquid in the second liquid chamber reaches the position above the other end of the third flow path and above the one end of the fourth flow path based on the signal output from one sensor.

According to an aspect (2) of the present disclosure, the sensor may be configured to, in response to the liquid level of the liquid stored in the second liquid chamber reaching the specific position, output the first signal.

In the foregoing configuration, the count value starting to be counted when the signal from the sensor is received accurately corresponds to a liquid level position in the second liquid chamber.

According to an aspect (3) of the present disclosure, the image recording apparatus may further include: a detection object that is configured to change a status in a state where the liquid level in the second liquid chamber reaches the specific position, wherein the sensor may be configured to detect the change in the status of the detection object and output the signal.

According to an aspect (4) of the present disclosure, the image recording apparatus may further include: an actuator that is supported to be rotatable about an axis and includes the detection object, wherein the actuator may further include a float with a lower specific gravity than the liquid.

According to an aspect (5) of the present disclosure, the specific position may be same as a position of the other end of the third flow path in the vertical direction.

In the foregoing configuration, after the sensor outputs the signal, no liquid flows from the first liquid chamber to the second chamber. Therefore, it is possible to more accurately report that the liquid level of the liquid in the second liquid chamber reaches the position below the other end of the third flow path and above the one end of the fourth flow path. The first notification can be performed at a timing at which the liquid may not flow from the first liquid chamber, that is, a timing at which the liquid may not be supplied from the cartridge.

According to an aspect (6) of the present disclosure, at the notification device activating the first notification, the liquid level of the second chamber may be equal to or below the other end of the third flow path, and wherein the liquid level of the second chamber at the notification device activating the first notification may be above the liquid level of the second chamber at the notification device activating the second notification.

According to an aspect (7) of the present disclosure, the specific position may be a central position of the third flow path at the other end in the vertical direction.

According to an aspect (8) of the present disclosure, the controller may be configured to, in response to receiving the signal from the sensor, control the notification device to activate the first notification.

According to an aspect (9) of the present disclosure, the controller may be configured to: determine whether the count value reaches a second threshold near than the first threshold from an initial of the count value; control, in response to the count value reaching the second threshold after receiving the first signal from the sensor, the notification device to activate the first notification.

According to an aspect (10) of the present disclosure, at the notification device activating the first notification, the liquid level of the second chamber may be below the other end of the third flow path, and the liquid level of the second chamber at the notification device activating the first notification may be above the liquid level of the second chamber at the notification device activating the second notification.

According to an aspect (11) of the present disclosure, the first notification may indicate that an amount of liquid in the cartridge is empty.

According to an aspect (12) of the present disclosure, the first notification may indicate a replacement of the cartridge.

According to an aspect (13) of the present disclosure, the controller may be configured to, in response to the count value reaching the first threshold, control the head to stop discharging the liquid via the head.

In the foregoing configuration, image recording is performed after the second notification, and it is possible to prevent air from flowing from the second liquid chamber to the fourth flow path.

According to an aspect (14) of the present disclosure, the controller may be configured to: receive a second signal from the sensor, the second signal output by the sensor in response to the liquid level being above the specific position; and control, in response to receiving the second signal after cancelling the stop of discharging the liquid via the head, the notification device to activate the first notification.

According to an aspect (15) of the present disclosure, the controller may be configured to: receive a second signal from the sensor, the second signal output by the sensor in response to the liquid level being above the specific position; and reset, in response to receiving the second signal after controlling the notification device to activate the first notification, the count value.

According to the present disclosure, it is possible to use the cartridge until a remaining amount of liquid stored in the first liquid chamber is small and it is possible to determine a remaining amount of liquid stored in the second liquid chamber at low cost with high precision is provided.

What is claimed is:

1. An image recording apparatus comprising:

an installation case that receives a cartridge, the cartridge including:

a first liquid chamber which stores a liquid;

a first flow path which includes one end communicating with the first liquid chamber;

a second flow path which includes one end communicating with the first liquid chamber and the other end communicating with an outside;

a tank that includes:

a second liquid chamber;

a third flow path which includes one end communicating with the outside and the other end communicating with the second liquid chamber, at least one of the first flow path and the third flow path configured to communicate with the first liquid chamber of the cartridge installed in the installation case and the second liquid chamber;

a fourth flow path which is below the third flow path in a vertical direction and communicates with the second liquid chamber;

a sensor;

a head that communicates with the other end of the fourth flow path;

a notification device; and a controller, wherein the controller is configured to:

receive a first signal from the sensor;

receive a discharging instruction to discharge the liquid via the head;

count a count value indicating an amount of liquid instructed to be discharged with the discharging instruction in response to receiving the discharging instruction after receiving the first signal from the sensor;

determine whether the count value reaches a first threshold; and control, in response to determining that the count value reaches the first threshold, the notification device to activate a first notification, wherein, when the first notification is activated, the liquid level of the second liquid chamber is between the other end of the third flow path and an end of the fourth flow path in the vertical direction.

2. The image recording apparatus according to claim 1, further comprising:

a detection object that is configured to change a status in a state where the liquid level in the second liquid chamber is equal to or below a specific position, the specific position being equal to or above the other end of the third flow path, wherein the sensor is configured to detect the change in the status of the detection object and output the first signal.

3. The image recording apparatus according to claim 2, further comprising:

an actuator that is supported to be rotatable about an axis and includes the detection object, wherein the actuator further includes a float with a lower specific gravity than the liquid.

4. The image recording apparatus according to claim 1, wherein the controller is further configured to control the notification device to activate a second notification in response to receiving the first signal from the sensor, the first signal output by the sensor in response to a liquid level in the second liquid chamber being equal to or below a specific position, the specific position being equal to or above the other end of the third flow path.

5. The image recording apparatus according to claim 4, wherein the specific position is same as a position of the other end of the third flow path in the vertical direction.

6. The image recording apparatus according to claim 5, wherein, when the second notification is activated, the liquid level of the second liquid chamber is equal to or below the other end of the third flow path, and wherein the first notification is activated by the notification device when the liquid level of the second liquid chamber, after the second notification is activated, is above the other end of the third flow path.

7. The image recording apparatus according to claim 4, wherein the specific position is a central position of the third flow path at the other end in the vertical direction.

8. The image recording apparatus according to claim 4, wherein the controller is configured to:

determine whether the count value reaches a second threshold near than the first threshold from an initial value of the count value;

control, in response to the count value reaching the second threshold after receiving the first signal from the sensor, the notification device to activate the second notification.

9. The image recording apparatus according to claim 8, wherein the second notification is activated when the liquid level of the second liquid chamber is below the other end of the third flow path, and wherein the first notification is activated by the notification device when the liquid level of the second liquid chamber, after the second notification is activated, is above the other end of the third flow path.

10. The image recording apparatus according to claim 9, wherein the second notification indicates that an amount of liquid in the cartridge is empty.

11. The image recording apparatus according to claim 9, wherein the second notification indicates a replacement of the cartridge.

12. The image recording apparatus according to claim 11, wherein the controller is configured to:

receive a second signal from the sensor, the second signal output by the sensor in response to the liquid level being above a specific position, the specific position being equal to or above the other end of the third flow path; and control, in response to receiving the second signal after controlling the head to stop discharging the liquid, the head to restart discharging the liquid.

13. The image recording apparatus according to claim 1, wherein the controller is configured to, in response to the count value reaching the first threshold, control the head to stop discharging the liquid.

14. The image recording apparatus according to claim 1, wherein the controller is configured to:

receive a second signal from the sensor, the second signal output by the sensor in response to the liquid level being above a specific position, the specific position being equal to or above the other end of the third flow path; and reset, in response to receiving the second signal after controlling the notification device to activate the second notification, the count value.

* * * * *